US009868121B2

(12) United States Patent
Kennedy et al.

(10) Patent No.: US 9,868,121 B2
(45) Date of Patent: Jan. 16, 2018

(54) SAFETY AND CONTROL DEVICE, SYSTEM, AND METHOD THEREOF FOR A WASTE PROCESSING SYSTEM

(75) Inventors: Richard S. Kennedy, Mt. Pleasant, MI (US); Scott R. Parks, Remus, MI (US); Michael J. Winnie, Mt. Pleasant, MI (US); Billy Joe Rose, Elwell, MI (US)

(73) Assignee: BANDIT INDUSTRIES, INC., Remus, MI (US)

( * ) Notice: Subject to any disclaimer, the term of this patent is extended or adjusted under 35 U.S.C. 154(b) by 759 days.

(21) Appl. No.: 14/237,130

(22) PCT Filed: Aug. 5, 2012

(86) PCT No.: PCT/US2012/049677

§ 371 (c)(1),
(2), (4) Date: Feb. 4, 2014

(87) PCT Pub. No.: WO2013/022809

PCT Pub. Date: Feb. 14, 2013

(65) Prior Publication Data

US 2014/0209721 A1 Jul. 31, 2014

Related U.S. Application Data

(60) Provisional application No. 61/515,346, filed on Aug. 5, 2011.

(51) Int. Cl.

| | |
|---|---|
| ***B02C 18/00*** | (2006.01) |
| ***B02C 25/00*** | (2006.01) |
| ***B02C 18/22*** | (2006.01) |
| ***B27L 11/00*** | (2006.01) |
| *B02C 18/16* | (2006.01) |

(52) U.S. Cl.
CPC ..... *B02C 25/00* (2013.01); *B02C 18/2283* (2013.01); *B02C 18/2291* (2013.01); *B27L 11/00* (2013.01); *B02C 2018/168* (2013.01); *B02C 2201/066* (2013.01)

(58) Field of Classification Search
CPC ..... B02C 25/00; B02C 18/38; B02C 18/2283; B02C 18/2291
USPC ..... 241/37.5, 92, 101.76
See application file for complete search history.

(56) References Cited

U.S. PATENT DOCUMENTS

| | | | |
|---|---|---|---|
| 3,182,917 | A | 5/1965 | Tamny et al. |
| 3,819,121 | A | 6/1974 | Rogers |
| 3,989,198 | A | 11/1976 | Blasko |
| 4,088,856 | A | 5/1978 | Tebben |
| 4,260,114 | A | 4/1981 | Herder |
| 4,442,877 | A | 4/1984 | Uitermarkt |
| 5,156,232 | A | 10/1992 | Muroya et al. |
| 5,170,313 | A | 12/1992 | Miller et al. |
| 5,434,457 | A | 7/1995 | Josephs et al. |

(Continued)

FOREIGN PATENT DOCUMENTS

| | | | |
|---|---|---|---|
| GB | 2098769 | A | 11/1982 |
| WO | WO2010126541 | | 11/2010 |
| WO | WO2013016607 | A1 | 1/2013 |

*Primary Examiner* — Faye Francis
(74) *Attorney, Agent, or Firm* — Howard & Howard Attorneys PLLC

(57) ABSTRACT

A waste processing system includes a cutting system and a feed system, wherein the improvement relates to a safety and control system which comprises a side mount actuator having at least two operable positions, wherein the actuator is in communication with the waste processing system and is adapted to selectively control the operation thereof.

16 Claims, 13 Drawing Sheets

(56) References Cited

U.S. PATENT DOCUMENTS

| | | | |
|---|---|---|---|
| 5,988,539 | A | 11/1999 | Morey |
| 6,000,642 | A | 12/1999 | Morey |
| 6,722,596 | B1 | 4/2004 | Morey |
| 6,729,567 | B1 | 5/2004 | Morey |
| 6,814,320 | B1 | 11/2004 | Morey et al. |
| 6,830,204 | B1 | 12/2004 | Morey |
| 6,955,310 | B1 | 10/2005 | Morey |
| 7,011,258 | B2 | 3/2006 | O'Halloran et al. |
| 7,040,558 | B2 | 5/2006 | Stelter et al. |
| 7,044,409 | B2 | 5/2006 | Stelter et al. |
| 7,083,129 | B2 | 8/2006 | Beam, III |
| 7,232,083 | B2 | 6/2007 | Stelter et al. |
| 7,594,620 | B2 | 9/2009 | Abramson et al. |
| 7,637,444 | B2 | 12/2009 | Stelter et al. |
| 2006/0261195 | A1 | 11/2006 | Beam, III |
| 2007/0001038 | A1 | 1/2007 | Bouwers et al. |
| 2007/0034295 | A1 | 2/2007 | Chapman |
| 2007/0257141 | A1 | 11/2007 | Stelter et al. |
| 2007/0267526 | A1 | 11/2007 | Uhrich et al. |
| 2008/0078851 | A1 | 4/2008 | Stelter et al. |
| 2008/0135653 | A1 | 6/2008 | Galloway et al. |

SAFETY AND CONTROL DEVICE, SYSTEM, AND METHOD THEREOF FOR A WASTE PROCESSING SYSTEM

CROSS REFERENCE TO RELATED APPLICATION

This application claims the benefit of the filing date of U.S. provisional application Ser. No. 61/515,346 entitled "Safety and Control Device, System, and Method Thereof for a Waste Processing System" which was filed on Aug. 5, 2011 and which is herein incorporated by reference.

BACKGROUND OF THE INVENTION

The present invention relates to waste processing systems, and more specifically to a safety and control device, a safety and control system, and methods thereof for a waste processing system.

A variety of machines have been developed to recycle, reduce, or otherwise process wood and brush products. Included therein are machines that chip, cut, grind, or otherwise reduce waste (wood) products including, generally, chippers (disk and drum types), hammer mills, hogs, shredders, grinders, and forestry mowers.

These waste processing systems typically include an infeed system and a waste reducing or cutting system, wherein the infeed system is used for directing the waste material to the waste reducing system, the waste reducing system being used for reducing the waste material. These waste processing systems also include a discharge system for removing and directing the reduced material.

These waste processing systems include large, industrial conveyor fed waste processing machines which are capable of quickly reducing bulky (e.g., large size) wood products, as well as doing so in high volume applications. For example, conveyor-fed systems may be used to reduce large tree stumps and trunks, as well as branches, brush, and other bulk wood products. These known systems generally include: an infeed assembly comprising, for example only, a conveyor infeed system; a feed wheel assembly comprising, for example only, a pair of feed-wheels; a cutting assembly comprising, for example only, a drum assembly further comprising reducing members; and a discharge assembly comprising, for example only, a conveyor discharge system.

Examples of such waste processing machines are disclosed in: U.S. Pat. No. 6,047,912, issued Apr. 11, 2000, entitled "Break-Away Processing Tool For A Waste Processing Machine"; U.S. Pat. Nos. 5,863,003 and 6,299,082; issued Jan. 26, 1999 and Oct. 9, 2001, respectively; all to Smith; and entitled "Waste Processing Machine"; U.S. Pat. No. 6,059,210 issued May 9, 2000 to Smith, entitled "Rotor Assembly For A Waste Processing Machine"; U.S. Pat. No. 6,517,020, issued Feb. 11, 2003 to Smith, entitled "Replaceable Raker Assembly For Processing Tool Of Waste Processing Machine"; U.S. Pat. No. 6,299,082, issued Oct. 9, 2001 to Smith, entitled "Waste Processing Machine"; U.S. Pat. Nos. 6,845,931, 7,121,485, 7,384,011, and 7,726,594; issued Jan. 25, 2005, Oct. 17, 2006, Jun. 10, 2008, and Jun. 1, 2010, respectively; all to Smith; and entitled "Multi-Functional Tool Assembly For Processing Tool of Waste Processing Machine"; and U.S. Pat. No. 7,163,166, issued Jan. 16, 2007 to Smith, entitled "Rotatable Assembly For Machines", all of which are incorporated herein by reference in their entirety.

These waste processing systems also include wood chippers. For example, hand-fed wood chippers are used to reduce trees, branches, brush, and other bulk wood products into smaller wood chips. A typical wood chipper includes an infeed chute; a feed system which may be adapted for controlling the feed rate of wood products; a wood chipping mechanism (disc or drum); a drive system for the feed system and chipping mechanism; and a discharge chute. More particularly, the infeed chute is typically a funnel-type conduit provided with a wide opening which tapers toward the feed system to converge the bulk wood/waste products toward the chipping mechanism and, through the action of the feed system, the bulk wood products are brought into contact with the chipping mechanism which grinds, flails, cuts, or otherwise reduces the wood and waste products into smaller pieces. The smaller pieces are then propelled out of the discharge chute. An example of such a wood chipper is disclosed in U.S. Pat. No. 5,988,539, issued Nov. 23, 1999 to Morey, and entitled "Wood Chipper With Infeed Chute Safety Device" which is incorporated herein by reference in its entirety. In these known systems, the wood chipper generally includes an infeed assembly, feed wheel assembly, and a cutting assembly having a rotatable disc or drum with at least one knife or blade for chipping the wood entering the wood chipper and reducing it to wood chips. The chipper also includes a discharge chute for allowing the wood chips to exit the wood chipper, as well as for generally directing them during discharge.

Other examples of such wood chippers are disclosed in U.S. Pat. No. 6,032,707, issued Mar. 7, 2000 to Morey et al., entitled "Drum Assembly For A Wood Chipper"; U.S. Pat. No. 6,036,125, issued Mar. 14, 2000 to Morey et al., entitled "Wood Chipper"; U.S. Pat. No. 5,988,539, issued Nov. 23, 1999 to Morey, entitled "Wood Chipper With Infeed Chute Safety Device"; U.S. Pat. No. 6,000,642, issued Dec. 14, 1999 to Morey, entitled "Wood Chipper With Infeed Chute Safety Device"; U.S. Pat. No. 6,722,596, issued Apr. 20, 2004 to Morey, entitled "Multiple Wheel Feed Wheel Assembly For A Wood Chipper"; U.S. Pat. No. 6,357,684, issued Mar. 19, 2002 to Morey, entitled "Adjustable Tension Feed Wheel Assembly For A Wood Chipper"; U.S. Pat. No. 6,830,204, issued Dec. 14, 2004 to Morey, entitled "Reversing Automatic Feed Wheel Assembly For A Wood Chipper"; U.S. Pat. No. 6,814,320, issued Nov. 9, 2004 to Morey et al., entitled "Reversing Automatic Feed Wheel Assembly For Wood Chipper"; all of which are incorporated herein by reference in their entirety.

Further, and by way of example only, the feed wheel assemblies of these waste processing systems, including wood chippers may comprise: a stationary lower feed wheel, connected to a lower housing; and a movable upper feed wheel, connected to an upper housing and movable relative to the lower housing for allowing wood to enter the cutting assembly. Further, one or both of the feed wheels may be rotatably powered or driven. These waste processing and chipper systems are also typically powered via an internal combustion, and again by way of example only: may include one or more hydraulic pumps which supply one or more hydraulic drives or motors for rotating the one or more feed wheels; and may also include one or more drive belts and pulley systems which drive the rotatable disc or drum of the cutting assembly.

However, although these types of waste processing systems are useful, if operated incorrectly problems can arise and, for example, failure of the operator to follow proper procedures, guidelines, and instructions (e.g., improper usage of the waste processing machine, its various systems, and/or is safety features) may result in damage to the machine or injury. For example, while the feed systems (e.g., feed wheels) are designed to feed bulk wood products to the cutting assembly, such systems are unable to discern what is being fed. By way of another example, and again when proper procedures are not followed, the cutting assembly (e.g., chipping mechanism) which is generally a large disc or drum which is designed to rotate at high speeds in order to produce the proper forces which are necessary to chip, cut, grind, or otherwise reduce the wood and/or waste products.

As such, and speaking with respect to wood chippers, it is generally desired therefore for the operator to feed such wood material to the infeed and feed systems while being located to the side of these system and, to the extent possible, reduce operating the machine from directly in front thereof.

The following prior art is disclosed and accomplishes, inter alia, some of the desired procedures, controls, and features that are discussed in more detail herein. For example, U.S. national application Ser. No. 13/318,142 entitled "SAFETY AND CONTROL DEVICE, SYSTEM, AND METHOD THEREOF FOR A WASTE PROCESSING SYSTEM" which was nationalized in the U.S. on Oct. 29, 2011, discloses, inter alia, numerous embodiments of foot pedals and other controls that may be positioned to the side of such waste processing machines in order to effectuate such feeding. Further yet, International Application No. PCT/US12/48461 entitles "WASTE PROCESSING MACHINE, VIGILANCE CONTROL SYSTEM, TIMER, AND METHODS THEREFOR" which was filed on Jul. 27, 2012 discloses, inter alia, numerous embodiments of timing systems and other controls that may also assist with safely feeding such waste processing machines, and both of these applications are also incorporated herein by reference in their entirety.

Therefore, there is a need in the art to provide safety and control systems, devices, and methods thereof which have, among other advantages, which reduce or prevent the risks associated with these prior art waste processing machines and which increase the control of and over these waste processing machines. It is also desirable to provide such systems and devices that are relatively inexpensive to manufacture, assemble, and are easily operable. It is also desirable to provide such systems, practices, and methods which increase safety and otherwise establish or promote the safe operation of these waste processing machines. Therefore, there is a need in the art to provide safety and control systems, devices, and methods for a waste processing system which overcomes the above-identified disadvantages.

Accordingly, a need exists for novel systems and methods which have, among other advantages, increasing the utilization, productivity, and efficiency of such systems; the ability to provide for increased safety while reducing or preventing the risks associated with these prior art waste processing machines. As well as being simple to operate and cost effective. It is further desirable to provide such devices and systems which are relatively inexpensive to manufacture, assemble, as well as are easily operable. It is also desirable to provide methods that are effective, cost effective, and are easily maintained and/or followed. Yet further, a need exists for novel devices, systems, and methods which have, among other advantages, the ability to assist with the proper control of these machines and the proper feeding of these machines.

Therefore, safety and control devices, systems, and associated methods that solve the aforementioned disadvantages and having the aforementioned advantages are desired.

SUMMARY OF THE PRESENT INVENTION

The aforementioned drawbacks and disadvantages of these former waste processing devices, systems, and methods have been identified and solutions are set forth herein.

A waste processing system according to the invention incorporates a control or safety device to, inter alia, prevent, stop, initiate, start, and otherwise run one or more of the primary systems of the waste processing systems, including for example, the feed wheel system of a hand fed wood chipper, while being located towards the side of the infeed tray, and without requiring the use of the operators hands to do so and in order to reduce or prevent injury to an operator or the equipment. Alternatively, a device to reverse the feed system, cutting mechanism, or both can be accomplished.

The improvement may be utilized in conjunction with any waste reducing machinery, either new or existing, and in one exemplary embodiment, the invention comprises a waste processing system including rotary feed wheels which are powered hydraulically, and when the control bar is depressed or moved rearwardly, for example via the operators body (e.g., upper or lower torso), the feed wheels will activate (for example, by causing hydraulic fluid to flow to the hydraulic motors), while when the control bar is not so biased, the feed wheels will deactivate (for example, by diverting hydraulic fluid from the hydraulic motors). In another aspect of the invention, the device reverses the flow of hydraulic fluid thereby reversing the direction of rotation of the feed system.

The novel devices, systems, and methods disclosed herein can be incorporated into any waste reducing machinery regardless of the drive system, and can be used to control or operate (e.g., cut-off, interrupt, reverse, prevent, stop, initiate, start) and otherwise run one or more of the primary systems of the waste processing machine including, inter alia, the feed systems. As such, the equipment and operators of these systems are provided with additional control, protection, and safety.

In one embodiment, the waste processing system comprises a cutting system and a feed system, wherein the improvement relates to a safety system which comprises an actuator having at least two operable positions, the actuator being in communication with the waste processing system and adapted to selectively control the operation thereof. Further, the actuator is mounted adjacent a side of an infeed assembly. Further aspects of alternate embodiments include: the actuator being mounted to a side of an infeed chute; the actuator being pivotally mounted to the infeed chute and comprising a storage position and a use position; the actuator being in mechanical communication with at least one of the feed system, the cutting system, and a power system; the actuator being operably connected electronically with at least one of the feed system, the cutting system, and a power system; the actuator being operably connected hydraulically with at least one of the feed system, the cutting system, and the a power system; the actuator being adapted to move between a first predetermined state and a second predetermined state; the actuator further being adapted to permit operation of the cutting system and the feed system when the actuator is in the first predetermined state, and the actuator being adapted to interrupt operation of at least one of the feed system and the cutting system when the actuator is in the second predetermined state; the actuator being operably connected to a diverter valve adapted to redirect a flow of hydraulic fluid from at least one of the feed system and the cutting system and toward a hydraulic reservoir when the actuator is in the second predetermined state; the actuator being adapted to permit operation of a feed control bar when the actuator is in the first predetermined state and the actuator being adapted to interrupt operation of the feed control bar when in the second predetermined state; the actuator comprises a normally open momentary switch; the actuator is adapted to restrict operation of at least one of the cutting system and the feed system when the actuator is in the second predetermined state; the actuator is adapted to permit operation of at least one of the cutting system and the feed system when the actuator is in the first predetermined state; the actuator is adapted to selectively control operation of at least one of the cutting system and the feed system when the actuator is in the first predetermined state; the actuator is adapted to selectively restrict operation of a feed control bar when the actuator is in the second predetermined state; the actuator being adapted to selectively control a feed control bar to permit operation of both the cutting system and the feed system when the actuator is in the first predetermined state, and to interrupt at least one of the feed system and the cutting system when the actuator is in the second predetermined state; wherein the waste processing system comprises a wood chipper; and may further comprise a pair of actuators, wherein each actuator is pivotally mounted to the infeed chute and comprises a storage position and a use position.

Another aspect of the present invention includes a waste processing system which comprises a cutting system and a feed system, wherein the improvement relates to a control system which includes an actuator disposed on the waste processing system on a side of an infeed chute. The actuator has at least two operable positions and is operably connected with the waste processing system to allow operation of the waste processing system upon positioning the actuator in a first position. Further embodiments include an actuator which is normally biased to a second position, wherein the first position must be manually maintained for operation of the waste processing system; and an actuator which is normally biased to a second position, wherein the first position must be continuously maintained in the first position for operation of the waste processing system.

In another aspect of the present invention, a waste processing system comprises a cutting system and a feed system, the improvement relating to a control system which comprises an actuator disposed on a side of an infeed chute. The actuator includes at least two operable positions, and is operably connected with the feed system, and adapted to selectively control operation thereof.

And still in another aspect of the present invention, a wood chipper is disclosed which comprises a torso activated actuator having at least two operable positions whereby the torso activated actuator is operably connected with a feed system to allow operation of the feed system when the torso activated actuator is in one of the two operable positions. Additional embodiment also include a wood chipper wherein: the actuator is operatively connected to a timer to allow operation of the feed system for a predetermined amount of time; the actuator is operatively connected to a timer to allow operation of the feed system for a predetermined amount of time; and after the predetermined amount of time elapses, the actuator must be cycled from the one of the two operable positions, to the other of the one of the two operable positions, and back to the one of the two operable positions for operation of the feed system for the predetermined amount of time; and may further comprise a locking pin to prevent the actuator from rotating when the locking pin is set to a locked position; a control bar, wherein the actuator is operatively connected to the wood chipper to allow operation of the feed system when the torso activated actuator is the one of the two operable positions and the control bar is in a first position; and a control bar, wherein the actuator is operatively connected to the wood chipper to allow operation of the feed system when the torso activated actuator is the one of the two operable positions and the control bar is maintained in a first position (and biased to not so be).

In yet another embodiment, a method of operating a waste processing system is disclosed and comprises: providing a waste processing system comprising a cutting system, a feed system, and a power system; providing a safety and control system comprising an actuator disposed on a side of the waste processing system and adapted to permit operation of the feed system when the actuator is in a first predetermined state, and adapted to interrupt operation of the feed system when the actuator is in a second predetermined state; moving the actuator in the first predetermined state; maintaining the actuator in the first predetermined state; Feeding material to the cutting system via the feed system in response to the actuator being in the first predetermined state; releasing the actuator to the second predetermined state; interrupting operation of the feed system in response to the actuator being in the second predetermined state. Additional steps may comprise: initiating a time cycle once the actuator is moved to the first predetermined state; and interrupting operation of the feed system in response to the time cycle having elapsed; as well as re-initiating the time cycle once the actuator is moved from the first predetermined state, to the second predetermined state, and back to the first predetermined state, thereby allowing operation of the feed wheels for the time cycle.

In still another embodiment, a method of operating a waste processing system is disclosed which includes: providing a waste processing system comprising a cutting system, a feed system, and a power system; providing a safety system comprising a torso activated actuator adapted to permit operation of the cutting system, the feed system, and the power system when the torso activated actuator is in a first predetermined state, and adapted to interrupt operation of at least one of the cutting system, the feed system, and the power system when the torso activated actuator is in a second predetermined state; determining if the torso activated actuator is in the first predetermined state or the second predetermined state; operating the cutting system, the feed system, and the power system in response to the actuator being in the first predetermined state and requiring that the actuator be continuously maintained in the first predetermined state for operation thereof; and interrupting operation of at least one of the cutting system, the feed system, and the power system in response to the actuator being in the second predetermined state.

In yet another embodiment, a control for use in combination with an existing waste processing system comprising a cutting system and a feed system is disclosed, wherein the control comprises: an actuator adapted to be mounted on a side of an existing waste processing system, the actuator having at least two operable positions; the actuator being adapted to communicate with at least one of a cutting system and a feed system of a waste processing system for selective control thereof when installed thereon; and wherein the actuator is adapted to be normally biased to a second position, whereas a first position must be continuously maintained by an operator for operation of the existing waste processing system.

In still another embodiment, a safety and control device for a wood chipper, the wood chipper comprising: an infeed assembly comprising an infeed hopper and an infeed chute, the infeed assembly for receiving waste material by an operator; a rotatable cutting assembly spaced from the infeed assembly; and a feed wheel assembly comprising at least one feed wheel disposed between the infeed assembly and the cutting assembly to feed wood material to the cutting assembly, is disclosed wherein the improvement relates to a control comprising: a control bar operatively connected to the feed wheel assembly to selectively control rotation of at least one feed wheel when moved by the operator, the control bar disposed adjacent a side of the infeed assembly in a position such that when (during feeding) an operator is disposing waste material into the infeed assembly, the operator may activate the control bar when loading. Further embodiment include: the control bar being activated by a body member of the operator, other than the operators hand(s); the control bar being activated by the operators lower torso; and the control bar being activated by the operators upper torso.

In yet another embodiment, a feed wheel control for a wood chipper comprises: an infeed assembly including an infeed hopper and an infeed chute, the infeed assembly for receiving waste material disposed thereon by an operator; a rotatable cutting assembly spaced from the infeed assembly for reducing waste material; a feed wheel assembly comprising at least one feed wheel disposed between the infeed assembly and the cutting assembly to feed wood material to the cutting assembly, the improvement related to a control comprising a control bar operatively connected to the feed wheel assembly to selectively control rotation of at least one feed wheel when moved by the operator, the control bar being disposed adjacent a side of the infeed assembly in a position and within an effective feeding zone such that when, during feeding, the operator is disposing waste material into the infeed assembly, the control is within reach of and may be activated by the operator when in the effective feeding zone. Further embodiment include: the control bar being activated by a body member of the operator, other than the operators hand(s); the control bar being activated by the operators lower torso; and the control bar being activated by the operators upper torso.

Other objects, advantages, and features of the invention will become apparent upon consideration of the following detailed description and drawings. As such, the above brief descriptions set forth, rather broadly, the more important features of the present novel invention so that the detailed descriptions that follow may be better understood and so that the contributions to the art may be better appreciated. There are of course additional features that will be described hereinafter which will form the subject matter of the claims.

In this respect, before explaining the preferred embodiment of the disclosure in detail, it is to be understood that the disclosure is not limited in its application to the details of the construction and the arrangement set forth in the following description or illustrated in the drawings. To wit, the safety and control devices, systems, and associated methods of the present disclosure are capable of other embodiments and of being practiced and carried out in various ways. Also, it is to be understood that the phraseology and terminology employed herein are for description and not limitation. Where specific dimensional and material specifications have been included or omitted from the specification, or the claims, or both, it is to be understood that the same are not to be incorporated into the claims, unless so claimed.

As such, those skilled in the art will appreciate that the conception upon which this disclosure is based may readily be used as a basis for designing other structures, methods, and systems for carrying out the several purposes of the present invention. It is important therefore that the claims are regarded as including such equivalent constructions, as far as they do not depart from the spirit and scope of the present invention.

Further, the purpose of the Abstract is to enable the United States Patent and Trademark Office, the public generally, and especially the scientists, engineers, and practitioners in the art who are not familiar with the patent or legal terms of phraseology, to learn quickly, from a cursory inspection, the nature of the technical disclosure of the application. Accordingly, the Abstract is intended to define neither the invention nor the application, which is only measured by the claims, nor is it intended to be limiting as to the scope of the invention in any way.

These and other objects, along with the various features and structures that characterize the invention, are pointed out with particularity in the claims annexed to and forming a part of this disclosure. For a better understanding of the safety and control devices, systems, and associated methods of the present disclosure, its advantages, and the specific traits attained by its use, reference should be made to the accompanying drawings and other descriptive matter in which there are illustrated and described the preferred embodiments of the invention.

As such, while embodiments of the safety and control devices, systems, and associated methods are herein illustrated and described, it is to be appreciated that various changes, rearrangements, and modifications may be made therein without departing from the scope of the invention as defined by the claims.

BRIEF DESCRIPTION OF THE DRAWINGS

As a compliment to the description and for better understanding of the specification presented herein, 13 pages of drawings are disclosed with an informative, but not limiting, intention.

DETAILED DESCRIPTION OF THE PREFERRED EMBODIMENT

The best mode for carrying out the invention is presented in terms of the preferred embodiment, wherein similar referenced characters designate corresponding features throughout the several figures of the drawings.

Figure 1:
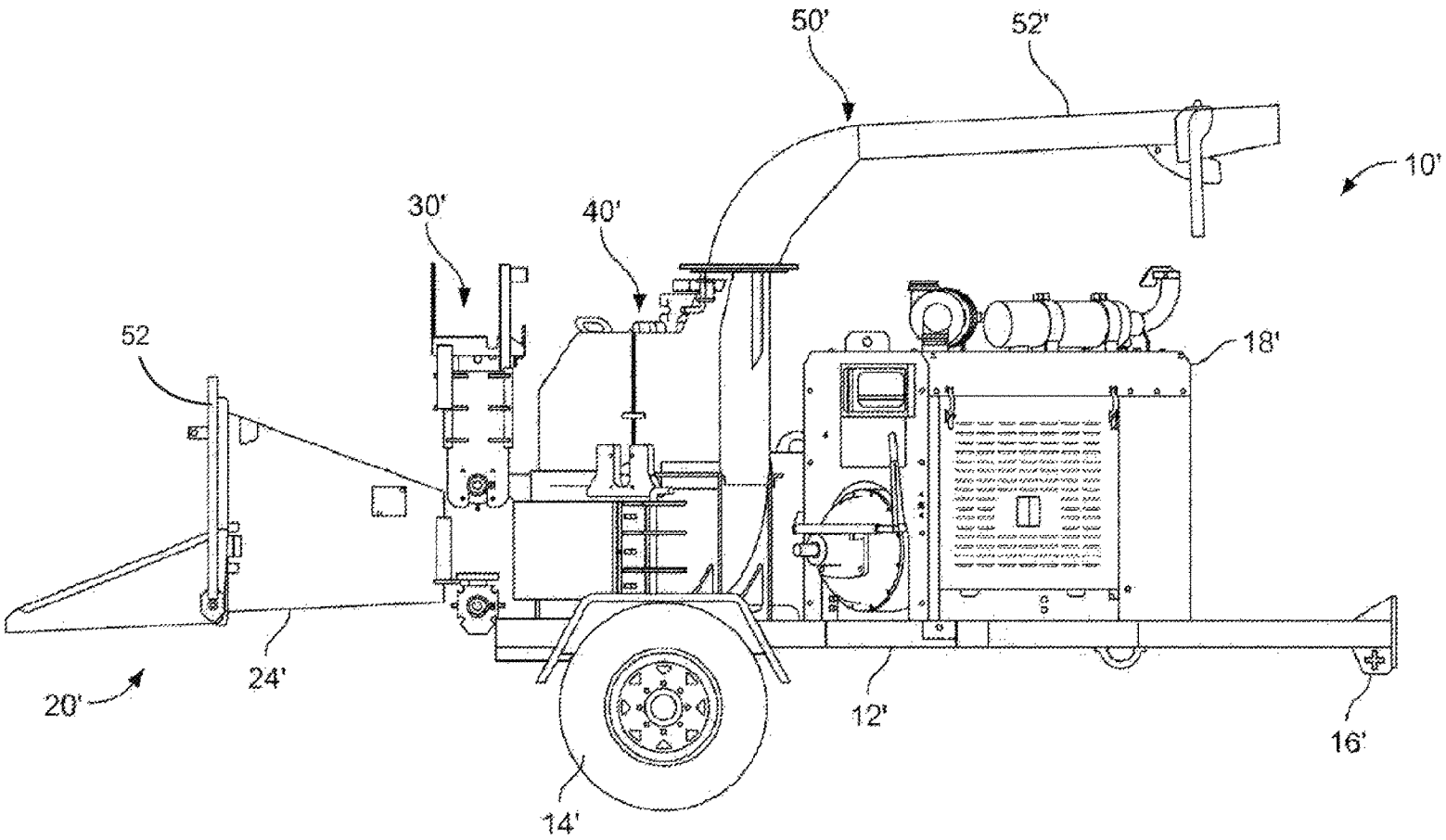
FIG. 1 (Prior Art)
FIG. 1 is a side view of a prior art disc type wood chipper.

For purposes of description herein, the terms "upper", "lower", "right", "left", "rear", "front", "vertical", "horizontal", and derivatives thereof, shall relate to the orientation illustrated in FIG. 1. However, it is to be understood that the invention may assume various alternative orientations, except where expressly specified to the contrary. It is also to be understood that the specific devices and processes illustrated in the attached drawings and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Reference will now be made in detail to the present preferred embodiments of the invention, examples of which are illustrated in the accompanying drawings. Wherever possible, these same referenced numerals will be used throughout the drawings to refer to the same or like parts. Like features between the various embodiments utilize similar numerical designations. Where appropriate, the various similar features have been further differentiated by an alphanumeric designation, wherein the corresponding alphabetic designator has been changed. Further, the dimensions illustrated in the drawings (if provided) are included for purposes of example only and are not intended to limit the scope of the present invention. Additionally, particular details in the drawings which are illustrated in hidden or dashed lines are to be considered as forming no part of the present invention.

As used herein, the term waste processing system is meant to be used and defined in its general and ordinary sense. To wit, systems that recycle, reduce, or otherwise process wood products. Included therein are machines that chip, cut, grind, or otherwise reduce wood waste products and include, generally, wood chippers, shredders, hammer mills, hogs, shredders, grinders, and/or forestry mowers, or the like). Of course, this is not meant to be limiting in any manner and these systems may take on numerous configurations, and may be used for numerous purposes as is generally known within the art.

As used herein, the terms wood and wood products are meant to be used and defined in their broad, general, and ordinary sense, and the terminology is meant to include trees, brush, trunks, stumps, stems, branches, leaves, or the like, or anything else that could otherwise be recycled, reduced, or otherwise processed; and further includes non-naturally occurring or manufactured wood products such as lumber, pallets, or other manufactured products that could otherwise be recycled, reduced, or otherwise processed, as is generally known within the art.

As used herein, the term primary system is meant to be used and defined in its general and ordinary sense. To wit, the systems of the waste processing machine that are responsible for the primary features and/or operation of the waste processing machine/system. Included therein are the feed system, the cutting system, and the power supply, source or engine. Of course, this is not meant to be limiting in any manner and these systems may take on numerous configurations, and may be used for numerous purposes as is generally known within the art.

Generally, while waste processing machines and wood chippers are commonly known and regularly utilized to reduce branches, trees, and other bulk wood products into smaller wood chips, if operated incorrectly problems can arise and, for example, failure of the operator to follow proper procedures, guidelines, and instructions (e.g., improper usage of the waste processing machine, its various systems, and/or is safety features) may result in damage to the machine or injury. As such, devices, systems and methods which effectuate better control of, increase the safety of, and reduce the risks associated with the operation of these waste processing machines are highly advantageous and thus desired.

For example, and speaking with respect to wood chippers, it is generally desired for the operator to feed wood material to the infeed and feed systems while being located toward, to, or on the side of these feed systems and, to the extent possible, reduce operating and controlling the machine from directly in front thereof.

The following prior art accomplishes, inter alia, operational control from positions other than directly in front of the feed system, and various procedures, controls, features, and methods are discussed in more detail therein. For example, U.S. national application Ser. No. 13/318,142 entitled "SAFETY AND CONTROL DEVICE, SYSTEM, AND METHOD THEREOF FOR A WASTE PROCESSING SYSTEM" which was nationalized in the U.S. on Oct. 29, 2011, discloses, inter alia, numerous embodiments of foot pedals and other controls that may be positioned to the side of such waste processing machines in order to effectuate such feeding. Further yet, International Application No. PCT/US12/48461 entitles "WASTE PROCESSING MACHINE, VIGILANCE CONTROL SYSTEM, TIMER, AND METHODS THEREFOR" which was filed on Jul. 27, 2012 discloses, inter alia, numerous embodiments of timing systems and other controls that may also assist with safely feeding such waste processing machines. The specifications of both of these applications are incorporated herein by reference in their entirety.

Therefore, there is a need in the art to provide safety and control systems, devices, and methods which have, inter alia, the following advantages: systems and methods which reduce or prevent the risks associated with these prior art waste processing machines; which increase the control of and over these waste processing machines; and that are relatively inexpensive to manufacture, assemble, and are easily operable. It is also desirable to provide such systems, practices, and methods which increase safety and otherwise establish or promote the safe operation of these waste processing machines, as well as provide methods that are effective, cost effective, and are easily maintained and/or followed. Yet further, a need exists for novel devices, systems, and methods which have, among other advantages, the ability to assist with the proper control of these machines and the proper feeding of these machines. Therefore, there is a need in the art to provide safety and control systems, devices, and methods for a waste processing system which overcomes the above-identified disadvantages.

More specifically, safety and control devices, systems, and associated methods for waste processing systems according to the present invention incorporate a control and safety device to, inter alia, prevent, stop, initiate, start, and otherwise run one or more of the primary systems of the waste processing systems, including for example, the feed wheel system of a hand fed wood chipper, while being located towards the side of the infeed tray, and without requiring the use of the operators hands to do so.

While not meant to be limiting in any manner, it is envisioned that this system may offer the following advantages: The safety system may be designed to interact with, cooperate with, or control one or more other safety systems of the waste processing machine, whether existing or developed in future. For example, in one embodiment, the invention will be configured in such a manner so as to allow for the independent operation of the waste processing system such that when the safety switch or actuator of the present invention is in a first state, the functions and operation of the waste processing system will be normal and, for example only, all other (existing) safety systems disposed on the waste processing system will operate as they would normally operate. However, when the switch or actuator is in a second state, the waste processing system will not operate as normal and, again for example only, the feed system may be restricted in its operation; in one embodiment the inventive system utilizes mechanical devices in its operation and therefore, may be more reliable than electrical and/or electronic devices. For example, the safety device may operate a mechanical valve disposed within the hydraulics of a feed system in order to operate, make inoperable, and/or reverse the feed system. Of course, electrical and electronic devices may also be utilized; in another embodiment, the safety device is retrofitable to existing waste processing systems; in another embodiment, the safety device is configured so as to require the device to be in a predetermined state (i.e., a first state) for normal operation of the waste processing system. Otherwise, the waste processing system will not operate as normal; in another embodiment, the safety device is designed to be used as a feed control bar. In yet another embodiment, the safety and control device is designed as a body member actuated device and in still another embodiment, the safety and control device is designed to be easily actuated from the side of the infeed assembly of a waste processing system.

As disclosed herein the safety and/or control device may be utilized as a feed control bar, either in conjunction with an existing control bars (e.g., hand feed, top control bars, foot pedals, and the like) or exclusively and as a replacement thereto.

For example, in a side mounted or body actuated embodiment, the control device may be utilized to start and stop the feed wheels of the system, thereby controlling the feed of the waste products from the side actuated bar. Again, and for example only, in one embodiment the operator may position the material to be chipped into the chute and then move to the side of the chute, away from the open chute, and operate the chipper (e.g., via his torso) without being exposed to the open infeed chute and without being required to use their hands.

For example, the operator may operate the feed wheels via the operators knee, thigh, hip, upper and or lower torso and the like, and of course, ones hand, arm, or elbow (e.g., any part of the body that the operator can utilize to press and hold the control in position when feed wheel operation is desired. This not only reduces the likelihood that the operator may be entangled therein, thereby increasing safety, it also makes it easier to operate the system. Of course, the control device could be used to operate and control other systems either exclusively, or in conjunction with the feed wheels.

In yet another embodiment, more than one of these control devices can be utilized. For example, both sides of the infeed chute can comprise a bar or actuator and, these bars may operate in unison or independently. Still further, they may both be configured to control the feed system, or to control differing systems. In one embodiment utilizing two controls (one on each side), both devices control the feed system (e.g., as a feed bar) and must be operated in unison; while in another embodiment each device acts as a control for independent operation from either side by a single operator.

In still other embodiments: the safety device may be utilized to start and stop the feed wheels of the system, thereby controlling the feed of the waste products from the side of the infeed chute and, again by way of example only, the operator may position the material to be chipped into the chute and then move to the side of the chute, away from the open chute, and operate the chipper via his hip or side and without being exposed to the open infeed chute, and while also keeping his hands free. This not only reduces the likelihood that the operator may be entangled therein, thereby increasing safety, it is also easier to operate the system in this configuration, as well as gives more control to the operator by freeing up the operators hands. Of course, the safety device could be used to operate and control other systems either exclusively, or in conjunction with the feed wheels.

While existing safety systems are designed to increase the operational safety of these mobile or trailerable waste processing machines, these existing safety features are designed to activate only in response to a particular occurrence or situation and therefore, may not activate under numerous, other circumstances. For example, a number of existing safety systems rely on the operator grabbing, pulling, or otherwise activating the safety feature in order to work. However, the particular situation for which the safety device is designed to operate within may either not arise; be deactivated or otherwise rendered inoperable by branches, brush, or the like; or be deactivated by the operator. Contrarily, the control and safety device of the present invention overcomes these existing problems.

For example, with a side or body controlled device as described further herein, if the operator is in trouble (pulled into or towards the feed chute or system) upon being lifted, moved, or otherwise re-positioned, the control device would automatically return to a neutral state (biased normal position) and deactivate or shut off the feed system in order to prevent injury. As such, the device can be configured to rely on the position of the operator being within a safe or effective feeding zone, as opposed to relying on the operator themselves for actuation. By way of further example, and when a timer in included, the system requires that the control be moved or cycled after a predetermined period expires to ensure that the system is functioning properly.

Referring now to the drawings and to FIG. 1 in particular, a prior art waste processing machine 10 comprises a wood chipper shown generally at 10' and includes a frame 12' supported by a pair of wheels 14', a conventional trailer hitch 16' to allow the chipper to be towed by a vehicle (not shown), and a power source 18'. Supported on frame 12', the wood chipper 10' includes: an infeed assembly or system 20' comprising an infeed tray 22' and an infeed chute 24' to allow wood material to enter the wood chipper; a feed system 30' comprising a feed wheel assembly (not shown), the feed wheel assembly typically comprising at least one feed wheel 19' (FIG. 10) and one or more feed wheel housings 36', disposed between the infeed system 20' and the cutting system 40', to feed wood material to the cutting system; the cutting assembly or system 40' is spaced from the feed system 30' and comprises cutters (not shown) and a cutting assembly housing 48'; and a discharge assembly 15' comprising a discharge chute 15A'.

The power source 18' typically comprises an internal combustion engine and provides rotational energy to both the feed wheels 19' (FIG. 10) of the feed system 30' and the cutting disc or drum (not shown) of the cutting system 40'. The engine 18' operatively couples the feed system 30' and cutting system 40' to cause rotation of the feed wheels 19' and the rotatable disc or drum (not shown). The engine 18' is typically operated such that the cutting disc/drum (not shown) rotates at a relatively high velocity, while the feed wheels 19' rotate relatively slowly. In operation, trees, brush, and other bulk wood products are fed into the infeed chute 24' and captured between, for example, opposed, rotating feed wheels 19' of the feed system 30' which feed, pull, or otherwise cause the bulk wood products to encounter the cutting disc/drum (not shown) of the cutting system 40'. The cutting system then reduces the bulk wood products into chips which are expelled through discharge assembly 15' via the discharge chute 15A'.

It will be understood that the wood chipper 10 may comprise any suitable waste reducing machinery such as the trailerable wood chipper as seen in FIG. 1 or any other movable or stationary machinery used to chip, grind, cut, or otherwise reduce bulk products. While one preferred embodiment incorporates a pair of opposed, horizontally aligned feed wheels, it is also to be understood that any feed system can be incorporated into the invention, or none at all. It will be further understood that this application describes the structure and operation of the feed wheels with respect to hydraulic systems, but that the feed wheels may be powered by any other suitable method. Further, while the preferred embodiment incorporates an internal combustion engine, the wood chipper can be powered by any other suitable methods including, but not limited to, electricity, gas, diesel, or a power take-off from an auxiliary power source without departing from the scope of this invention.

Figure 1A:
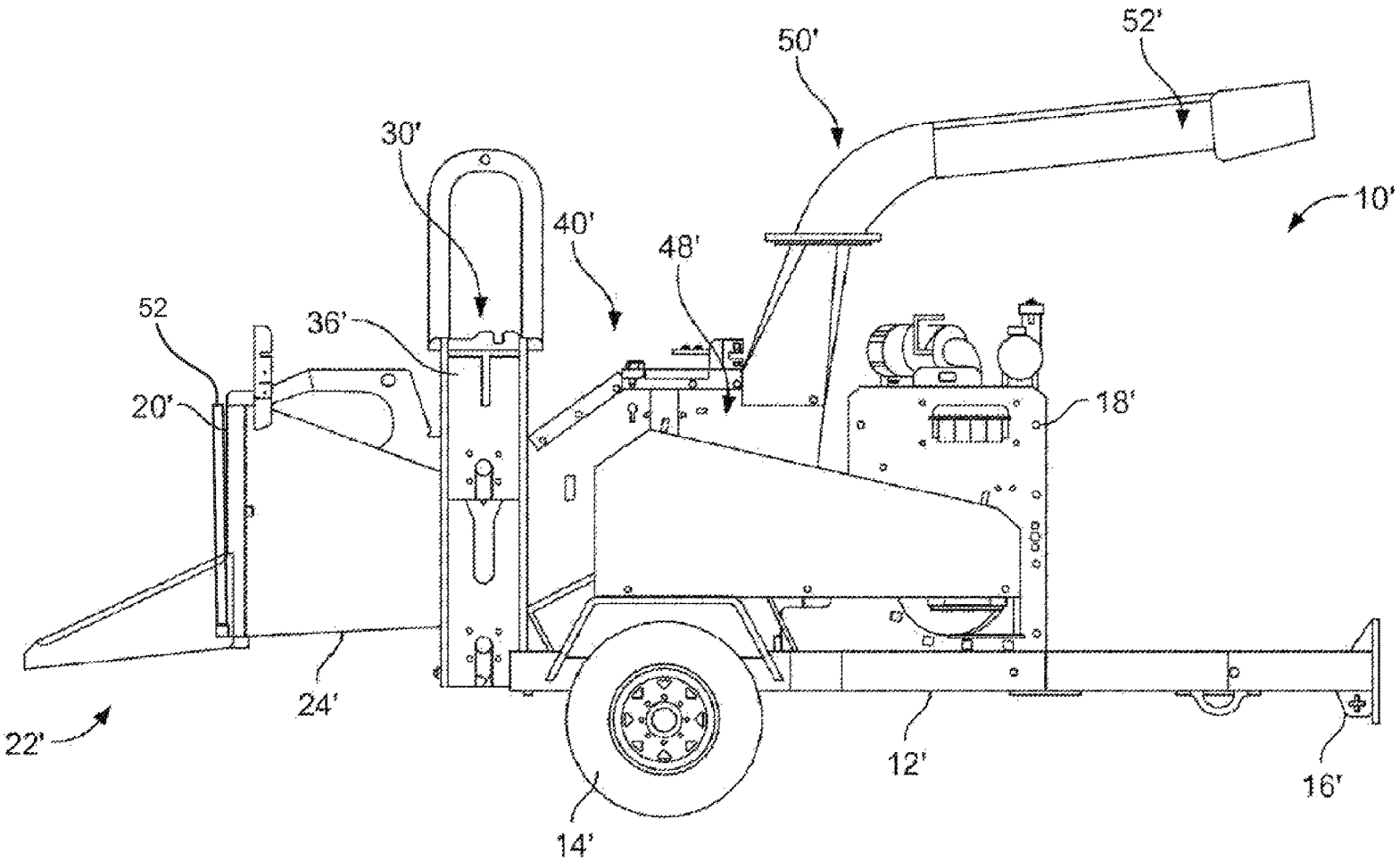
FIG. 1A (Prior Art)
FIG. 1A is a side view of a prior art drum type wood chipper.

In general, these prior art chippers 10' may include: a rotatable shaft (not shown) operatively connected to the engine 18', the engine shaft comprising a pulley (not shown) disposed about an end of the shaft (not shown); a rotatable shaft (not shown) operatively connected to the rotor (e.g., disc/drum) of the cutting assembly 40', the rotor shaft comprising a pulley (not shown) disposed about one end of the shaft; the chipper further includes a belt or belts (not shown) disposed over and interconnecting the engine and rotor shaft pulleys. It should be appreciated that the engine 18' rotates the cutting assembly 40' via the belts, and typically a hydraulic pump (not shown) pumps hydraulic fluid to rotate the feed wheels 19' (FIG. 10) of the feed system 30'. FIG. 1 illustrates a prior art waste processing machine 10' which includes a disc style cutting assembly 40', while FIG. 1A illustrates a prior art waste processing machine 10' which includes a drum style cutting assembly 40'.

Figure 2:
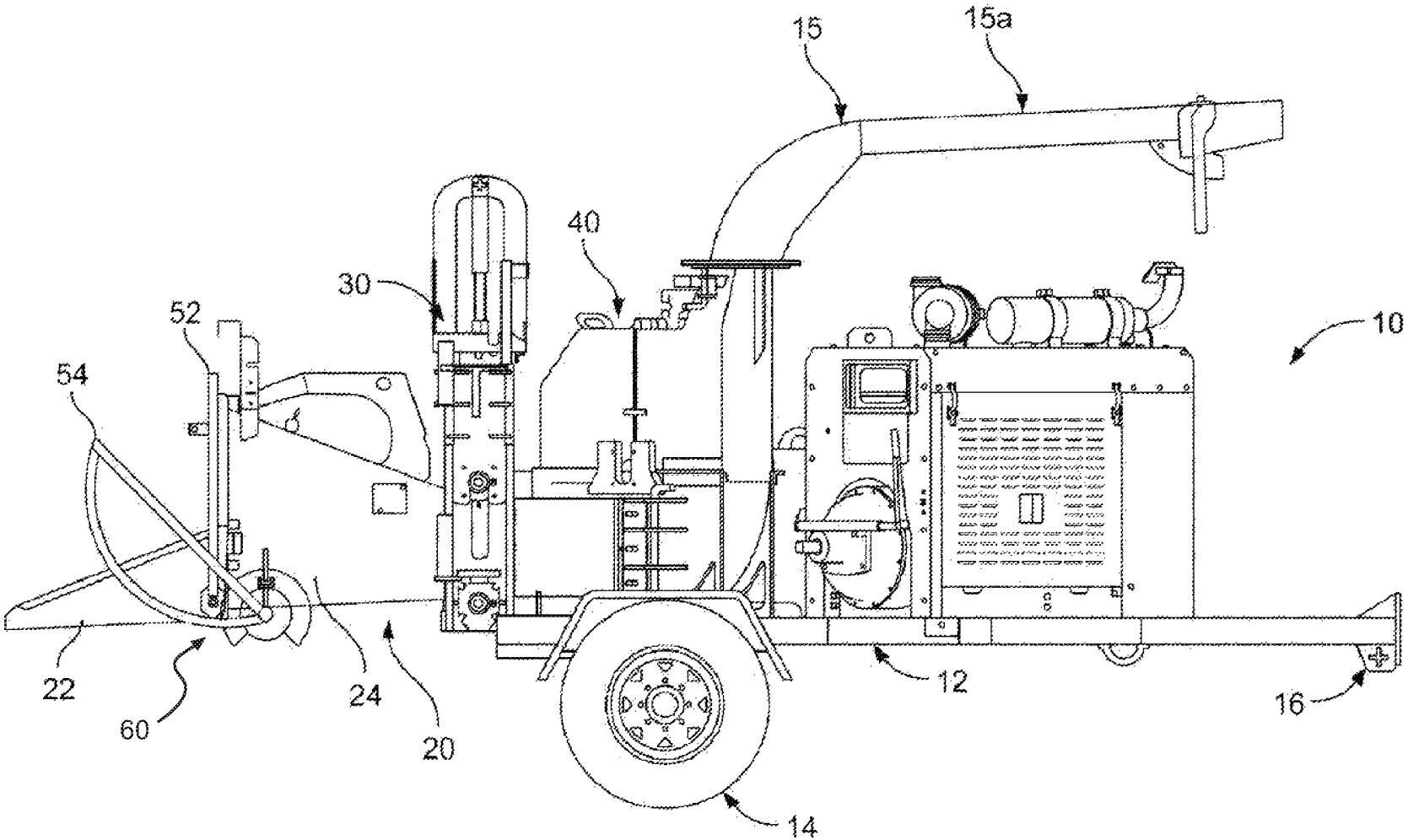
FIG. 2 is a side view of a wood chipper according to one embodiment of the present invention.

The disadvantages and drawbacks of the prior art are overcome through the waste processing system of the present invention, wherein one preferred embodiment 10 is disclosed. Referring now to FIG. 2, one embodiment of a waste processing system is shown generally at 10 and includes a frame 12 supported by a pair of wheels 14, and a trailer hitch 16 in order to allow the waste processing system to be transported by a vehicle. Supported on the frame 12 are a cutting system 40, an infeed chute 20, and a discharge chute assembly 15. A power system 18, typically comprising an internal combustion engine, is also mounted on frame 12 to provide power to both a feed system 30 and the cutting system 40.

As is generally known, operation of waste processing system 10 typically comprises providing power to the cutting system 40 and the feed system 30 through power supply 18, whereby feed system 30 feeds or supplies material to cutting system 40, and cutting system 40 is used to reduce or otherwise process the wood products which are then dispensed through discharge chute assembly 15. Cutting system 40 may comprise a rotary cutting mechanism, blade, or disc (not shown), and feed system 30 may generally comprise a feed wheel system (also not shown). Both of these systems being described in great detail in the patents cited hereinabove and those descriptions are wholly included herein, in their entirety, by reference.

In a broader sense, FIG. 2 illustrates an embodiment of the control system, vigilance system, or safety system 60 which includes, is operatively connected, or otherwise in communication with an actuator 54, and includes a timer. Actuator 54 may comprise any actuator, switch, bar, pedal, and the like which selectively controls the operation of one or more of the primary systems of the waste processing system 10. These primary systems include the feed system 30, the cutting system 30, and the power system 18. For exemplary purposes only, the actuator 54 may comprise one or more of a side feed control bar. Further, the discussion herein will detail the use of the actuator 54 as it operates and interacts with the feed system 30, and more particularly the feed wheels of the feed system 30. However, it is to be understood that the actuators 54 may be configured to operate with the other primary components of the waste processing system 10, either alone or in combination with the feed wheels.

It is generally known to provide a wood chipper with a top feed control bar 52 which requires the operator to move the bar in order to operate the feed system. Top feed control bar 52 may comprise, for example, a multi-position bar/switch wherein the bar must be moved by the operator and/or held or biased to a first position in order for the feed system 30 to be operable. The top feed control bar 52 may be configured to remain in this first position for continuous operation, or the top feed control bar 52 may be designed to be normally biased towards a neutral position which does not allow operation of the feed system unless moved from its normally biased position. If for any reason the operator lets go of the top feed control bar 52, the bar 52 will move to its normally biased neutral position and the feed system will cease to operate.

While prior art systems comprising a top feed control bar provide good control and offer safety features that have substantially increased the performance, efficiency, overall utility, and safety of these machines, improvements are still desired which increase control and safety.

Figure 10:
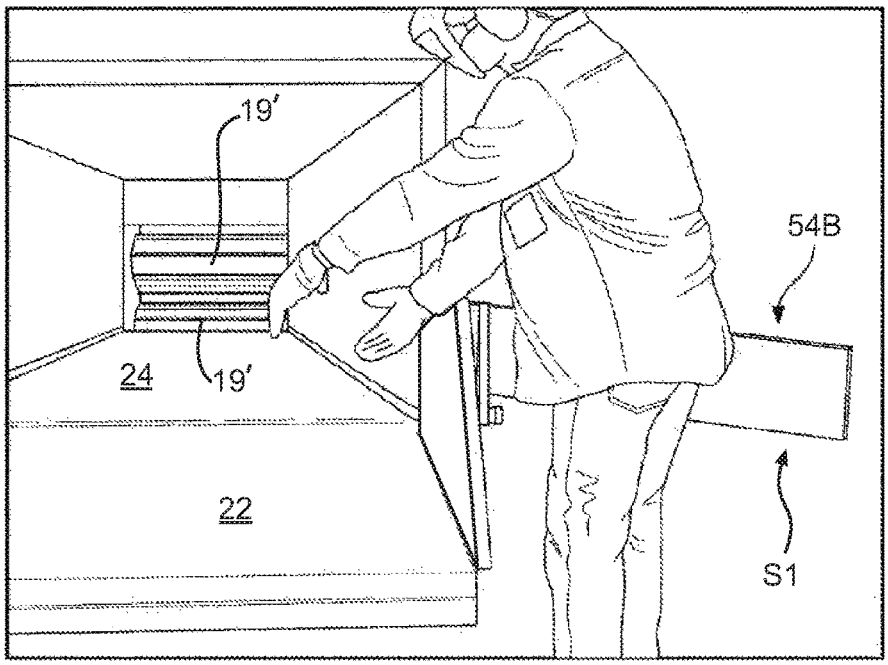
FIG. 10 is a partial front view of the infeed chute of FIG. 8, being loaded.

The disadvantages and drawbacks of the prior art are overcome through the waste processing system of the present invention, wherein one preferred embodiment is disclosed. Referring now to FIGS. 2-7, one embodiment of a waste processing system is shown generally at 10 and includes a frame 12 supported by a pair of wheels 14, and a trailer hitch 16 in order to allow the waste processing system to be transported by a vehicle. Supported on the frame 12 are an infeed assembly 20 including an infeed tray 22 and chute 24, a feed assembly 30 including one or more feed wheels 19' (FIG. 10), a cutting system 40 including a rotatable cutting assembly (not shown), and a discharge system 15 including a discharge chute 15A. A power system 18, typically comprising an internal combustion engine, is also mounted on frame 12 to provide power to both the feed system 30 and the cutting system 18. As is generally known, operation of waste processing system 10 typically comprises providing power to the feed system 30 and cutting system 40 via power supply 18, whereby feed system 30 feeds or supplies cutting system 40, and cutting system 40 is used to reduce or otherwise process the wood products which are then dispensed through discharge chute 15A. Cutting system 40 may comprise a rotary cutting mechanism (disc or drum, not shown), and feed system 30 may generally comprise one or more feed wheels 19' (FIG. 10).

It should be understood that waste processing system 10 may comprise any suitable waste reducing machinery such as the trailerable wood chipper as seen in FIG. 1, or any other, typically, movable machinery used to chip, grind, cut, or otherwise reduce bulk products. Further, while the preferred embodiment incorporates a pair of opposed, horizontally aligned feed wheels, it is understood that any feed system may be utilized. It should be further understood that this disclosure describes the structure and operation of a safety and control system 60 with respect to a hydraulic system, however, other powering systems may also be utilized. Still further, the waste processing system 10 is described and illustrated as being operated by an internal combustion engine, however, the system may also be powered by any other suitable method, including, but not limited to, electricity, gas, diesel, or a power take-off from an auxiliary power source, without departing from the scope of this invention. In a broader sense, FIG. 2 illustrates an embodiment of the safety and control system 60 wherein is shown a waste processing system 10 including the primary systems of a cutting system 40, a feed system 30, a power supply or source 18. In general, cutting system 40, feed system 30, and power source 18 are known in the art. Further, it is to be understood that numerous configurations of these known devices may be used and the description herein is not meant to be limiting with respect to these systems, unless otherwise noted, and equivalent components may be used.

Referring now to FIGS. 2-7, a first embodiment of the safety and control system 60 is illustrated wherein is shown a safety and control system 60 which comprises, inter alia, an actuator 54 having at least two operable positions (e.g., on or off). The safety and control system 60 and actuator 54 are operably connected to or otherwise in communication with one or more of the primary systems of waste processing system 10, and are adapted to selectively control the operation thereof. For illustrative purposes only, the selective control of these systems may comprise selectively powering, driving (forward or reverse), interrupting, stopping, braking, or otherwise operating one or more of the primary systems of the waste processing system including, for example, the power supply 18, the cutting system 40, and the feed system 30. As illustrated, actuator 54 is positioned on a side 101 of the infeed assembly 20. Of course, alternatively and/or in addition to side 101, actuator 54 could be positioned on side 102.

Actuator 54 may include any bar, rod, handle, actuator, or the like that an operator can move, bump, or otherwise adjust into a working or on position and as shown in this embodiment, comprises a generally D-shaped armature which is fixed to a shaft 58 for rotation thereon, wherein the shaft 58 is disposed below the infeed assembly 20 (FIG. 6) and operatively connected to one or more of the primary systems.

Figure 13:
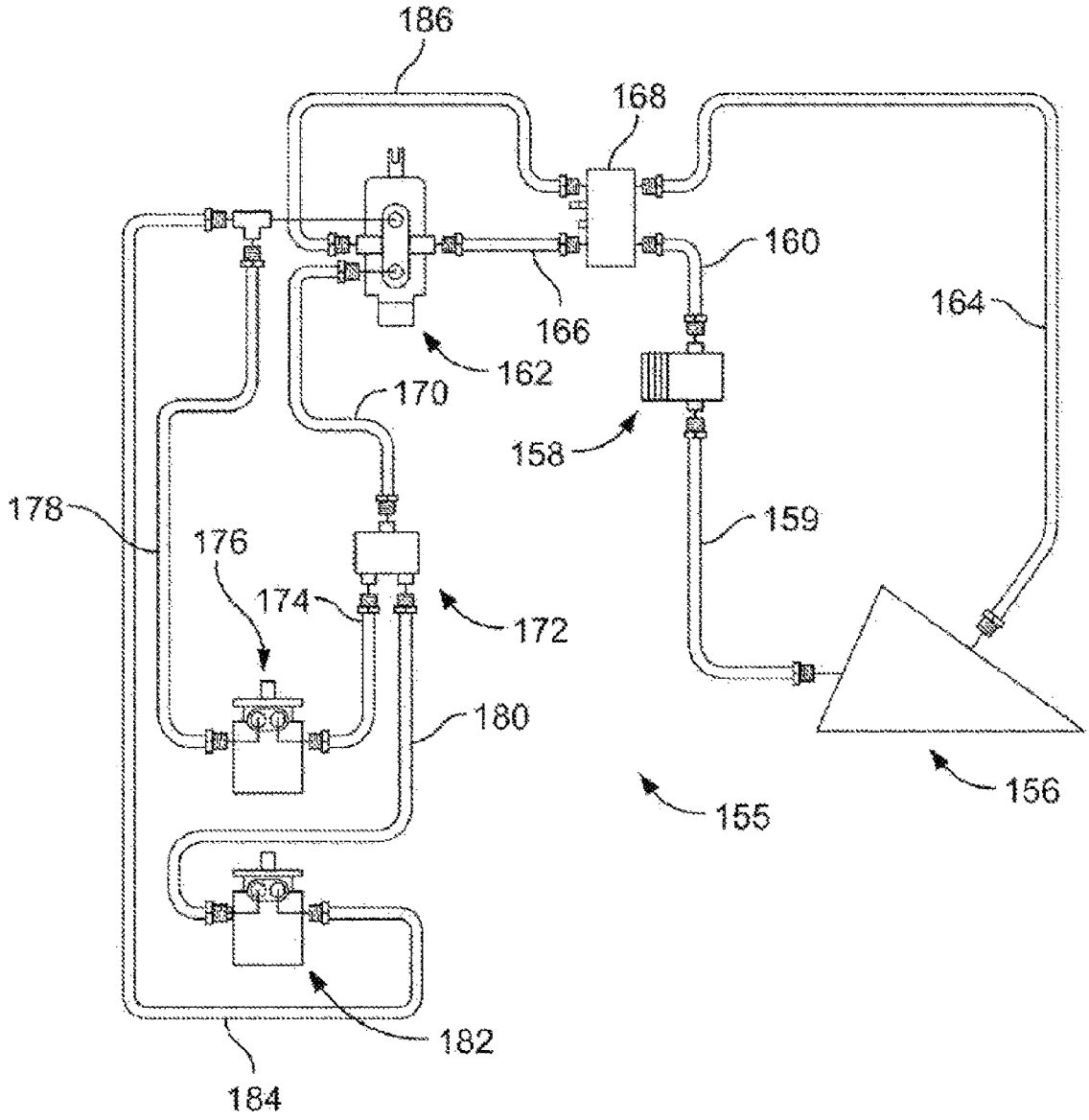
FIG. 13 is a diagrammatical illustration of a hydraulic system according to one embodiment of the present invention.

In this embodiment, shaft 58 is operatively connected to the hydraulics, and more particularly to a hydraulic valve 162 (FIG. 13) via a link 64. The hydraulic valve 162 is operatively connected to the one or more feed wheels. Further, while a mechanical connection is illustrated, the invention is not to be so limited. Yet further, the system 60 may also be operatively connected to any known timing system for safety and vigilance control thereof and as discussed in international application No. PCT/US12/48461 entitled "WASTE PROCESSING MACHINE, VIGILANCE CONTROL SYSTEM, TIMER, AND METHODS THEREFOR" which was filed on Jul. 27, 2012 and discloses, inter alia, numerous embodiments of timing systems and other controls that effectuate the purpose of this device and this application is incorporated herein by reference in its entirety.

Figure 3A:
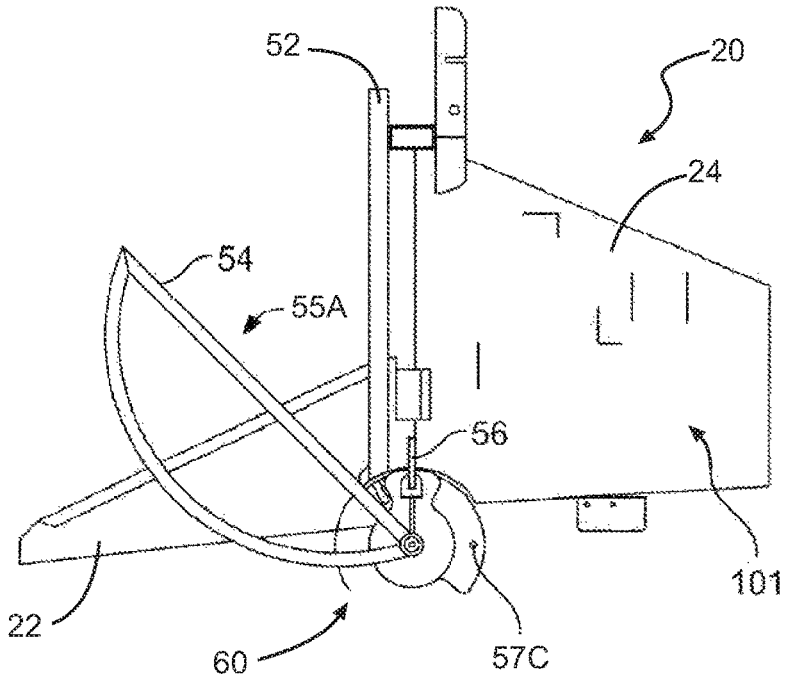
FIG. 3A is a partial side view of an infeed chute of a wood chipper illustrating an embodiment of the present invention in an operable position.
Figure 3B:
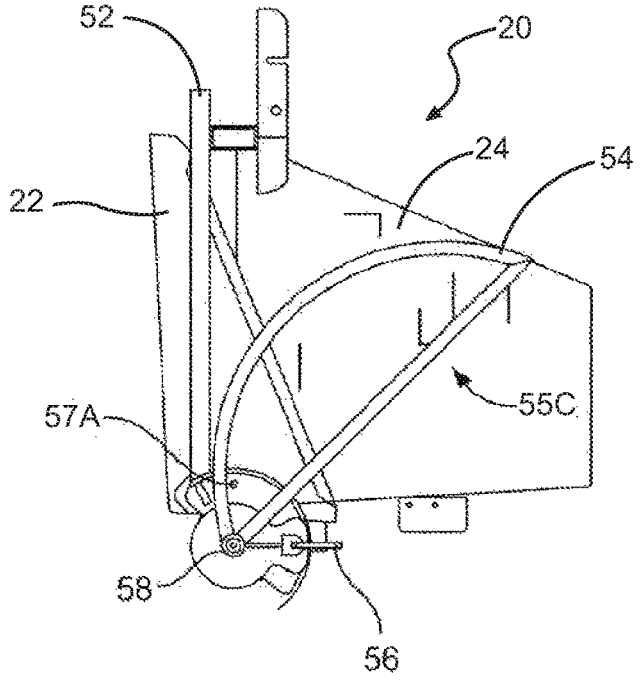
FIG. 3B is a partial side view of the infeed chute of FIG. 2.

FIGS. 3A and 3B illustrate the actuator 54 in being in a first position or ready position 55A, wherein the actuator 54 may be biased to remain in said position (for example under its own weight) and wherein further the feed wheels are inactive or otherwise made inoperable; and in a third position or stored position 55C, wherein the actuator 54 is securely stored for transportation of the unit 10 and wherein further the feed wheels are inactive or otherwise made inoperable. A second position or a use position may be any position of the actuator 54 between the ready position 55A and third the storage position 55C and wherein further the feed wheels are active or otherwise made operable when therein.

Figure 4A:
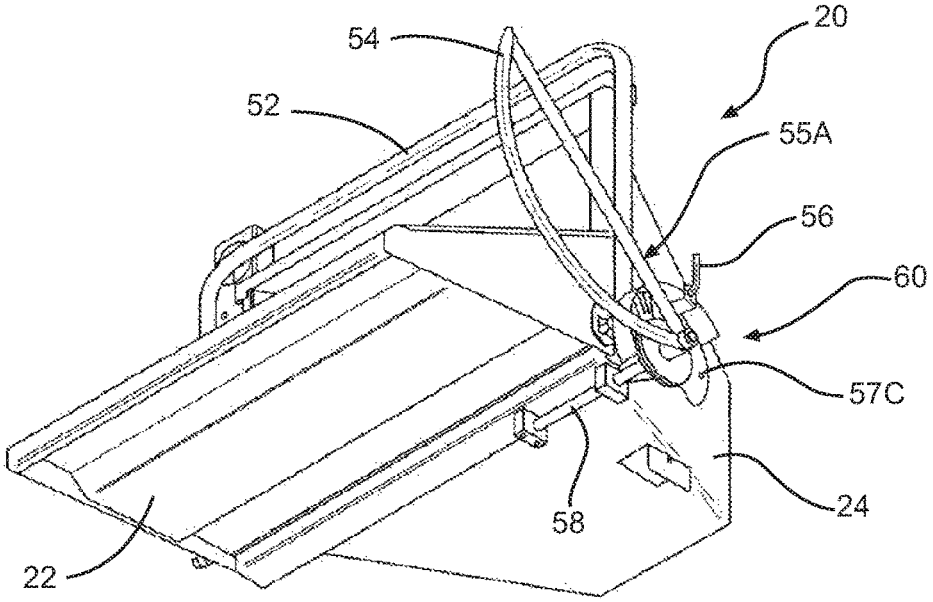
FIG. 4A is a partial front-bottom perspective view of the infeed chute of FIG. 2.
Figure 4B:
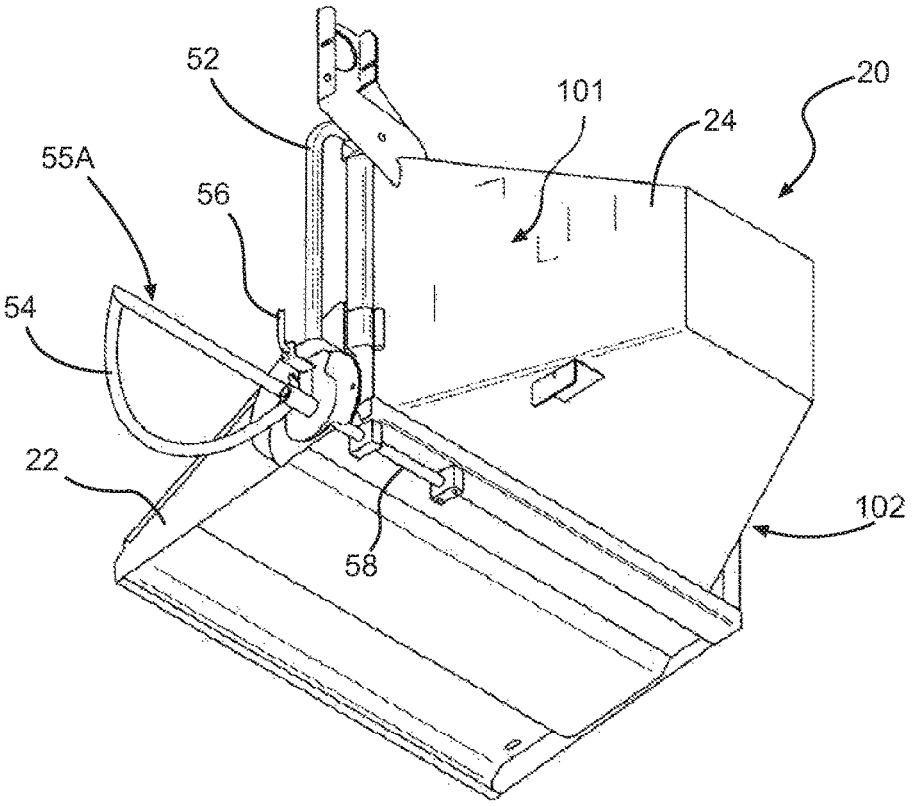
FIG. 4B is a partial rear-bottom perspective view of the infeed chute of FIG. 2.
Figure 4C:
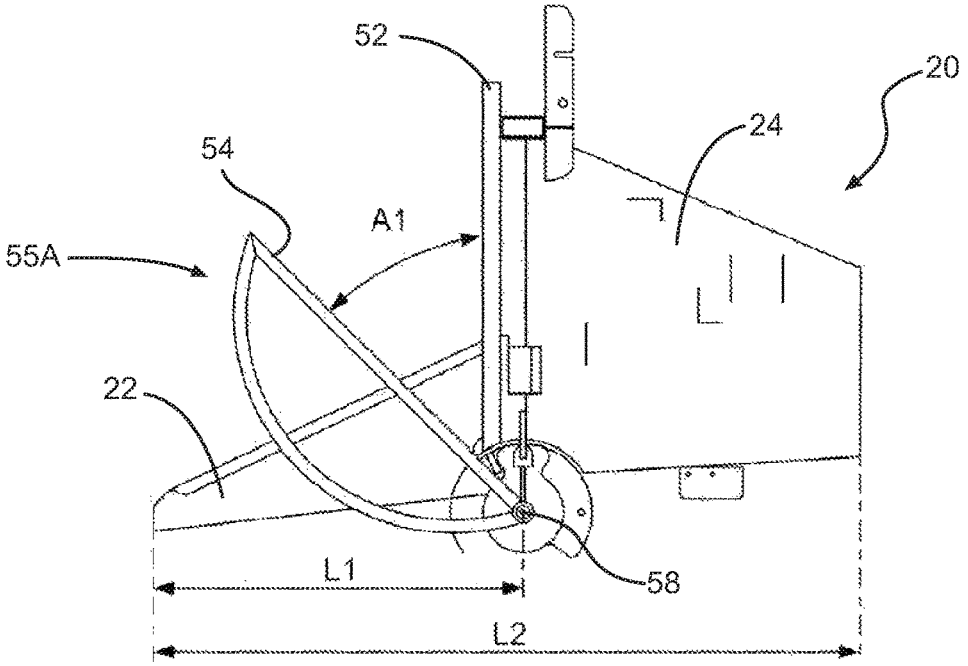
FIG. 4C is a partial side view of the infeed chute of FIG. 2.

As illustrated in FIGS. 4A-C, the shaft 58 is disposed a distance L1 from a front of the infeed tray 22; a distance L2–L1 from a rear of the infeed chute 24; and the ready position 55A comprises an angle A1 from the vertical.

Figure 5A:
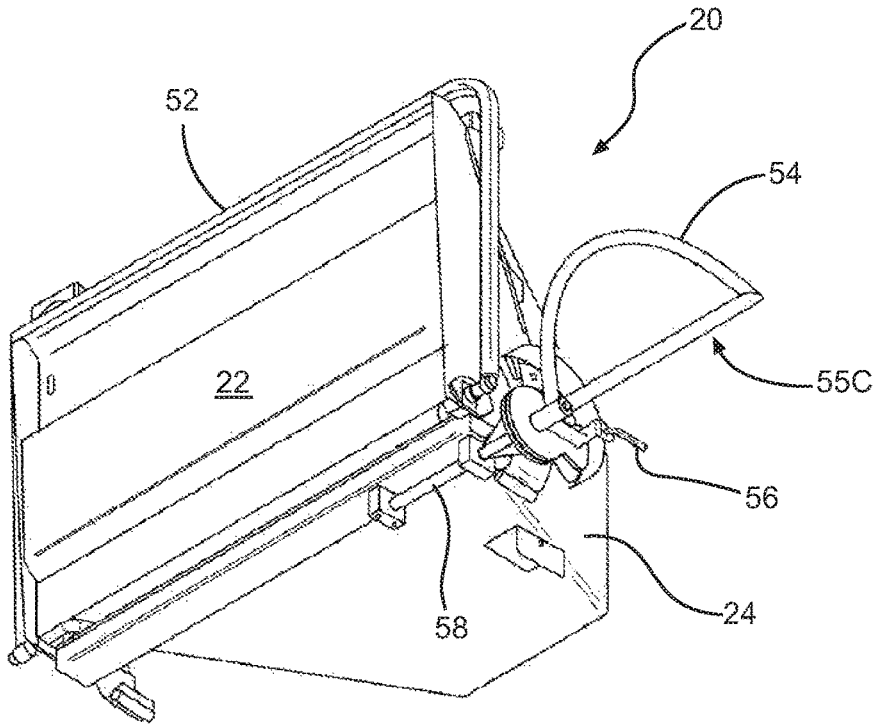
FIG. 5A is a partial front-bottom perspective view of the infeed chute of FIG. 2 in a closed position.
Figure 5B:
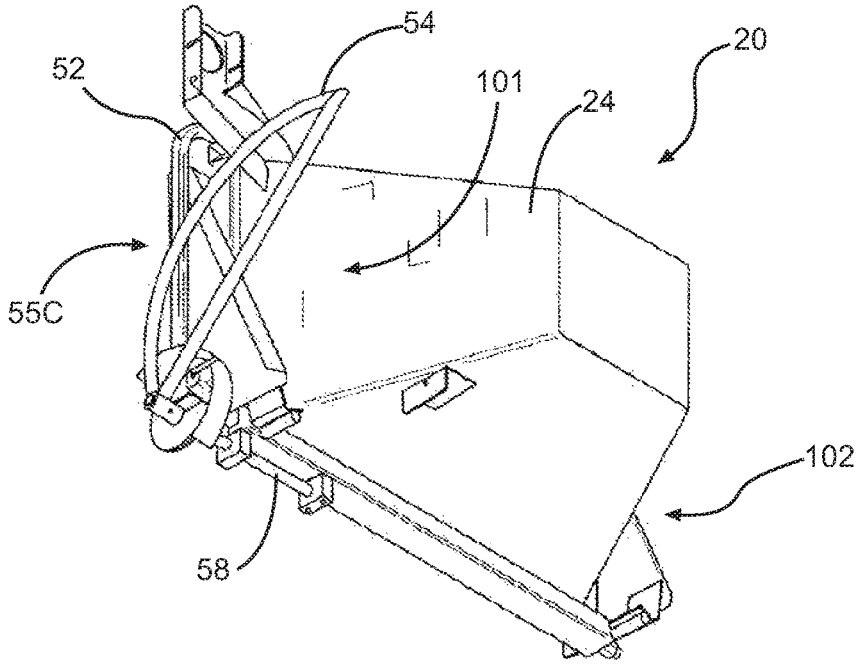
FIG. 5B is a partial rear-bottom perspective view of the infeed chute of FIG. 2 in a closed position.
Figure 5C:
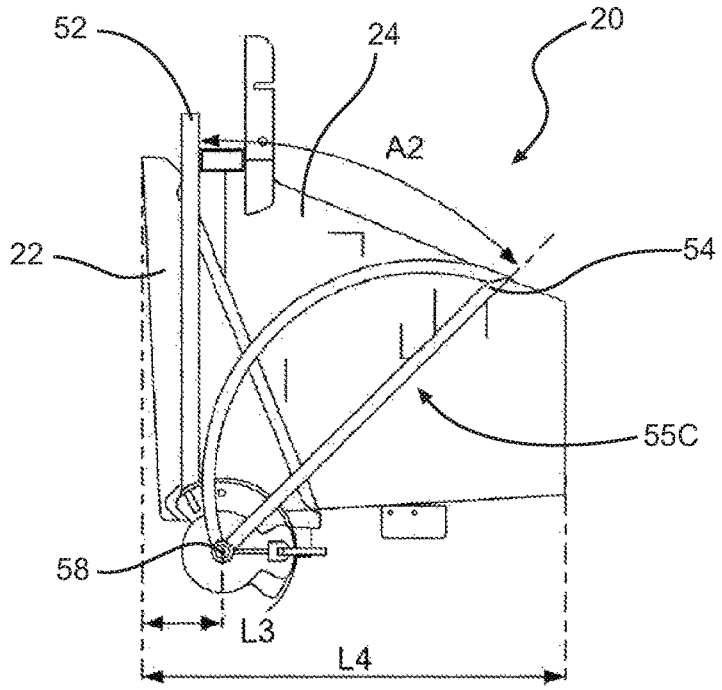
FIG. 5C is a partial side view of the infeed chute of FIG. 2 in a closed position.
Figure 6:
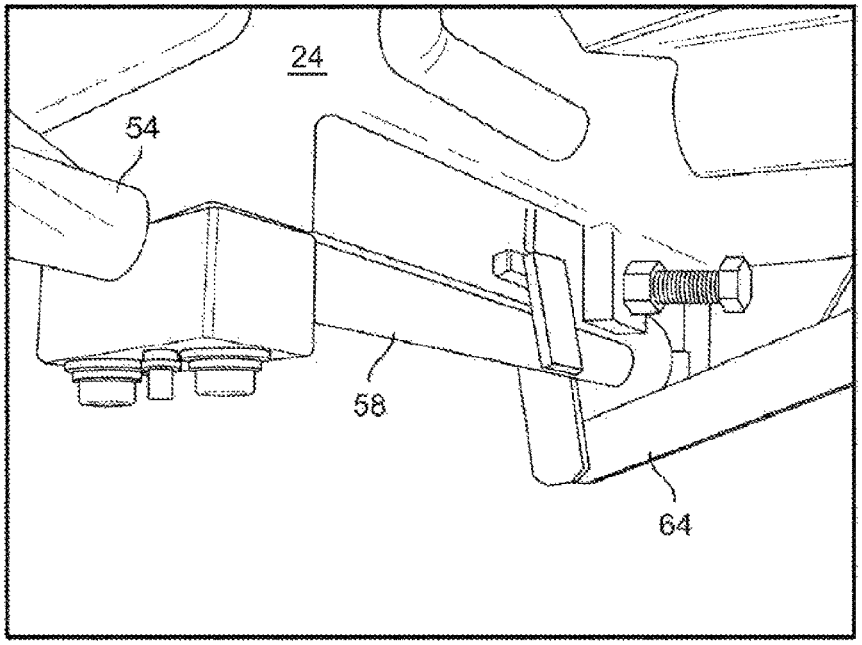
FIG. 6 is a partial bottom view of the infeed chute of FIG. 2.
Figure 7:
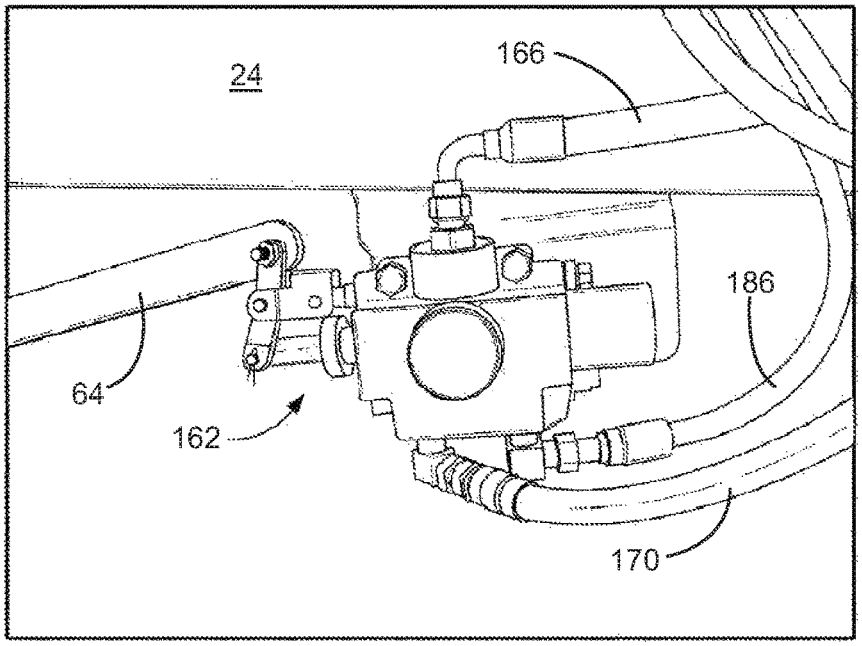
FIG. 7 is a partial side view of the infeed chute of FIG. 2.

FIGS. 5A-C illustrate the actuator 54 being in the stored position 55C, wherein the actuator 54 is securely stored for transportation and wherein the shaft 58 is disposed a distance L3 from a bottom of the infeed tray 22; a distance L4–L3 from a rear of the infeed chute 24; and the stored position 55C comprises an angle A2 from the vertical.

As described, the use position 55B may comprise any position of the actuator 54 between the ready 55A and use 55C positions. In one preferred embodiment the actuator 54 is operatively connected to the waste processing machine 10 such that the use position 55B includes all positions between the ready position as shown in FIG. 4C and the vertical.

FIG. 3 also illustrates a pin, key or lock 56 that comprises a spring loaded pin that retains the actuator 54 in either the ready position 55A or the stored position 55C. In use, the pin, key or lock 56 is pulled out (against the bias of the spring) and rotated towards one of the desired positioning holes, and then released in the desired positioning hole, wherein positioning hole 57C is for locking the actuator 54 in the storage position 55C, and positioning hole 57A is for locking the actuator 54 in the ready position 55A.

Again, while a single actuator 54 is illustrated on side 101, multiple actuators 54 may be used for operation in unison or independently thereof.

Figure 8:
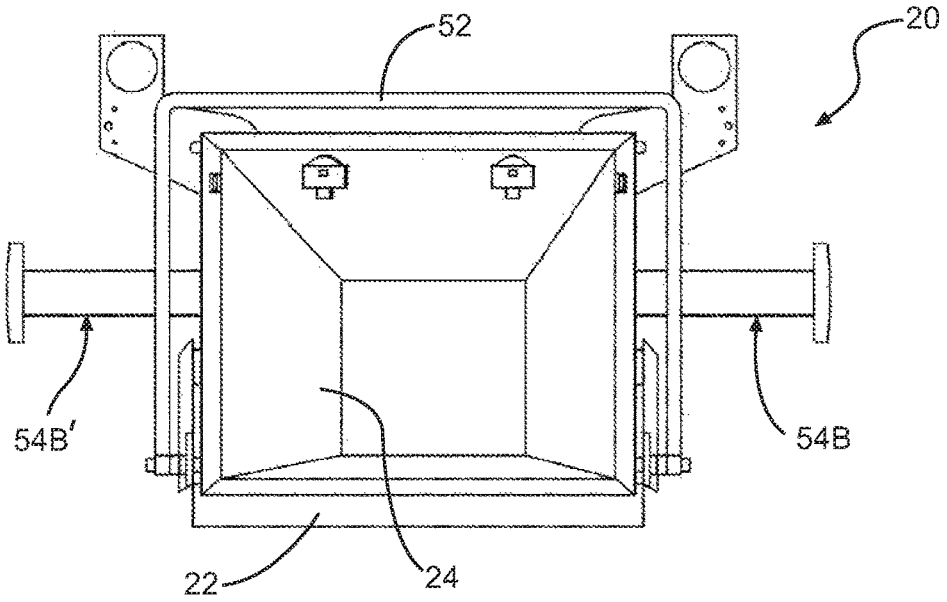
FIG. 8 is a partial front view of an infeed chute of a wood chipper illustrating an alternate embodiment of the present invention.
Figure 8A:
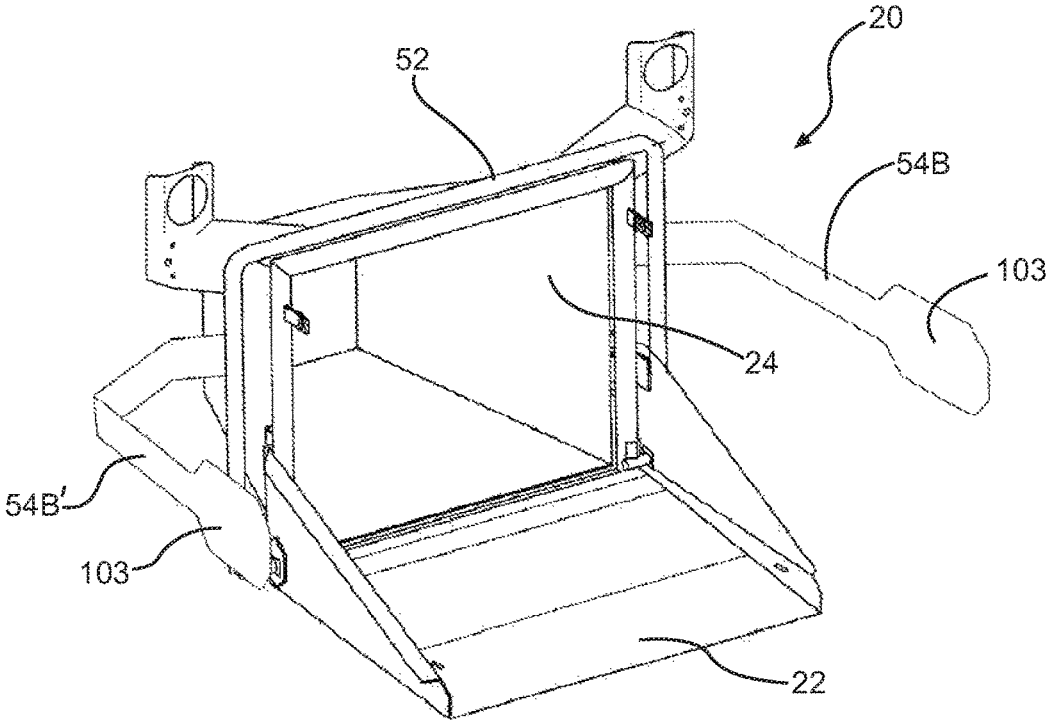
FIG. 8A is a partial perspective view of the infeed chute of FIG. 8.
Figure 9:
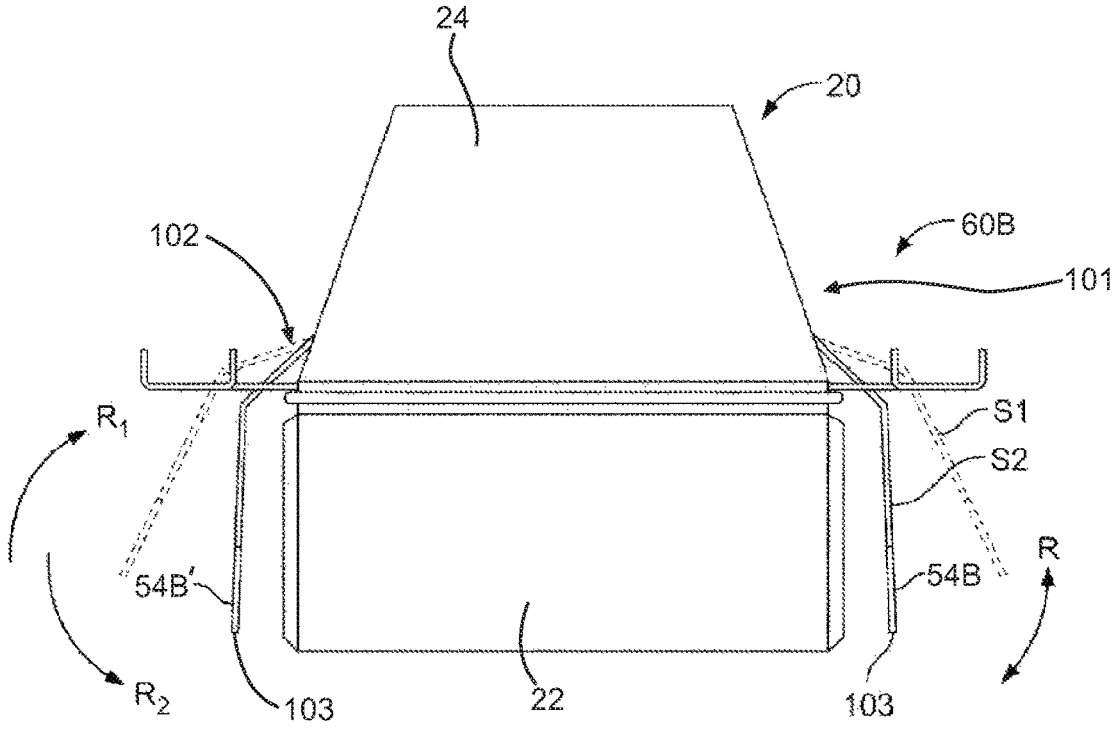
FIG. 9 is a partial top view of the infeed chute of FIG. 8.

FIGS. 8, 8A, and 9 illustrate yet another embodiment of the safety and control system 60B which includes, inter alia, actuator or bar 54B. In this embodiment, one or more actuators 54B are configured to be operable from one or more sides of the infeed chute 20 (e.g., rotatable or pivotable from front to rear). The actuator 54B is operatively connected to one side 101 and 102 of infeed assembly 20 (e.g., infeed chute 24) so as to be pivotable or rotatable in a direction R (e.g., rearwardly in a direction R1 or forwardly in a direction R2).

The configuration and operable characteristics of embodiment of the safety and control system 60B are similar to the previous embodiments described herein, and may be either directly in communication with one or more of the primary systems of waste processing system 10, or indirectly in communication therewith. For example, safety and control system 60B may be operatively connected to one or more of the primary systems to permit normal operation of waste processing system 10 when actuator 54B is in the use position or a first predetermined state S1 (e.g., positioned or activated rearwardly), and to selectively restrict control of the top feed control bar 52 when the actuator 54B is in the ready position or a second predetermined state S2 (e.g., normally biased, not activated, positioned forwardly or otherwise de-activated). Additionally, one exemplary embodiment utilizes a pair of actuators 54B/B' with one of which operatively connected to each side 101/102 of infeed chute 24 and disposed such that the upper body (e.g., the torso) of an operator is used to move, position, or rotate one of the pair of actuators 54B/B' via a pad 103 from the ready position S2 to the use position S1 so as to allow operation of the feed wheels, as illustrated in FIG. 10. The actuators 54B are normally biased to the ready position S2 which does not allow for normal operation of the feed wheels, such that when the operator does not move the actuators 54B/B' into the use position S1 (e.g., the operator has released the actuators 54B/B' or is otherwise not in position), the actuators 54B/B' automatically return or remain in the ready position S2. For example, in one embodiment actuators 54B/B' is spring biased to remain and/or return to the ready position S2 when not otherwise pushed or moved, and maintained, in the use position S1 or alternatively, when not in the ready position S2. In this manner, an operator may remain to one side of the infeed assembly 20 when the feeding operation is commencing.

Additionally, waste processing system 10 may be transported when actuators 54B/B' are in a stored position (not shown) wherein actuators 54B/B' are positioned or otherwise stored inwardly with respect to the infeed chute 20.

Figure 11:
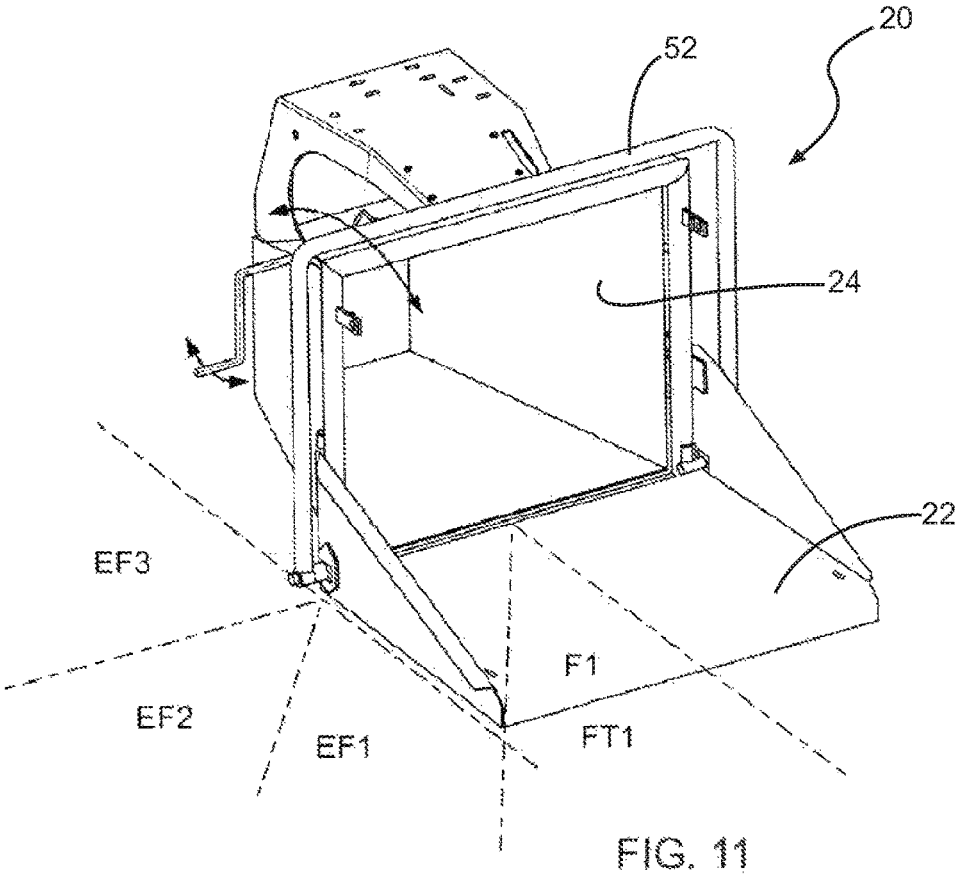
FIG. 11 is a partial perspective view of a prior art infeed chute illustrating various loading zones.
Figure 12A:
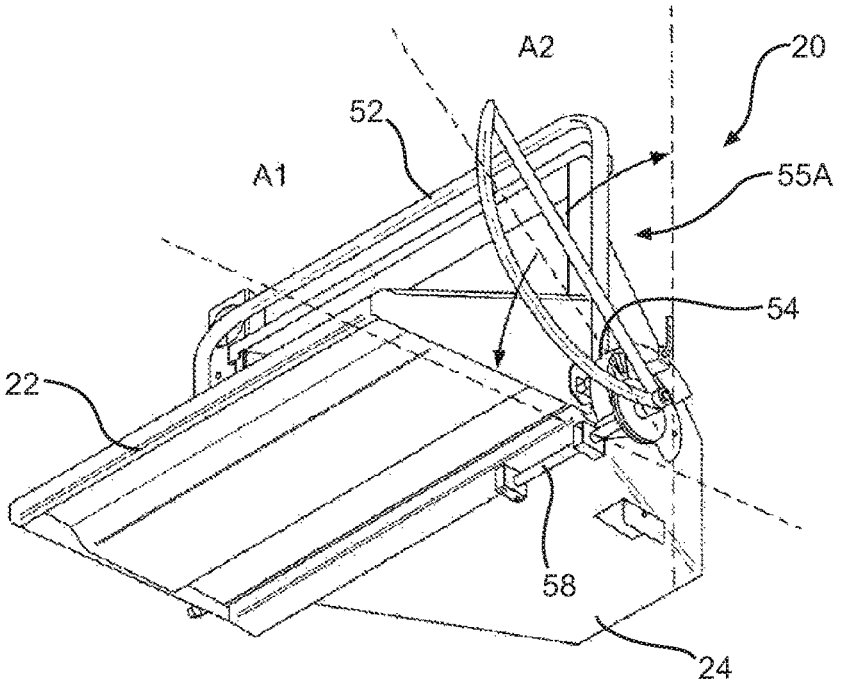
FIGS. 12A and 12B are a partial perspective views of an infeed chute of the present invention illustrating various loading zones.
Figure 12B:
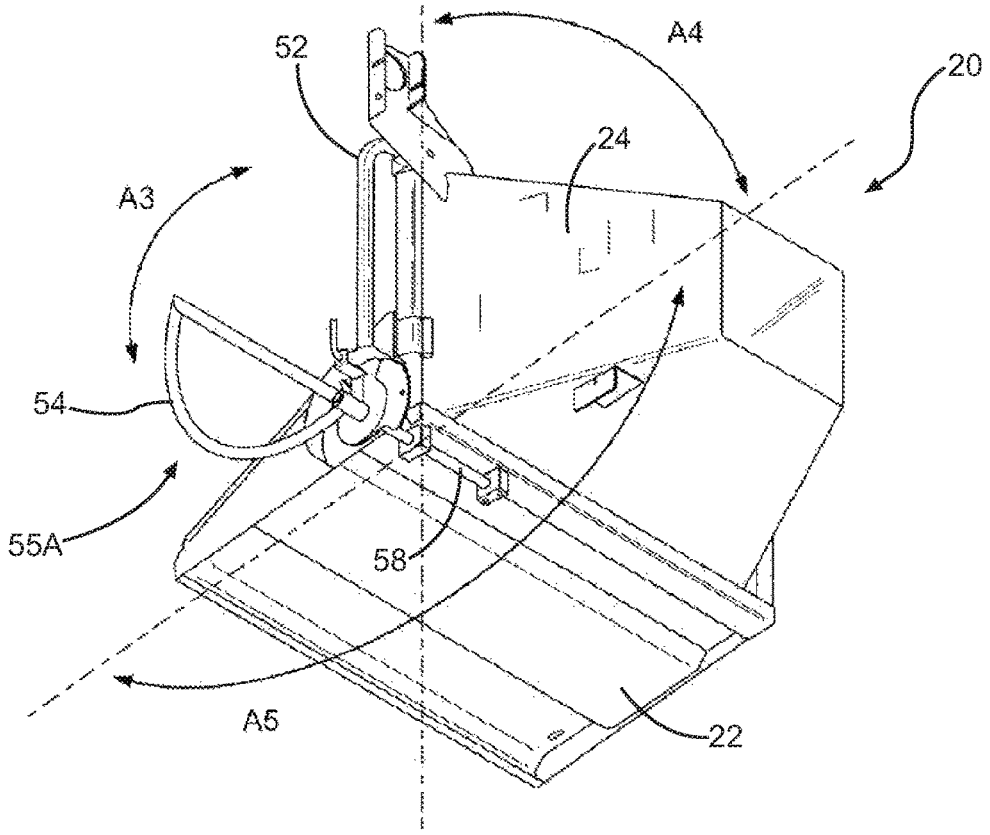

As illustrated by FIGS. 10-12, and for exemplary purposes only, utilizing a feed system comprising an upper and lower feed wheel, the operator feeds material to the system from a frontal-side direction of the machine as illustrated in FIG. 10. Generally speaking, the feeding operation may be best accomplished when the operator is in an effective feeding zone of the waste processing machine. The effective feeding zone as herein defined is illustrated in FIG. 11-12 and comprises the zones as represented by and inclusive of zones EF1, EF2, and EF3 (e.g., A5 and A3+A4 of FIG. 12B), wherein zones EF1 and EF2 (e.g., A3 of FIG. 12B) are more preferred, and zone EF2 (e.g., A2 of FIG. 12A) is most preferred. The effective feeding zone comprises the area wherein the operator has sufficient control over the bulk material and feeding thereof to properly feed the waste processing machine. While zone FT1 may be used to feed the system, generally speaking it is more desirable to load the system from the side.

Control and safety system 60 may be operatively connected to the feed wheels in any known manner and may comprise, for example, mechanical connections, electrical connections, hydraulic connections, and the like. In one embodiment, utilizing a feed wheel system which is hydraulically operated (and diagrammatically represented in FIG. 13), the connection may comprise a mechanical system that is operably connected to the hydraulic system 155 of the feed wheels in order to effectuate control. For example and referring to FIG. 13, an exemplary hydraulic control system 155 is illustrated which includes a storage tank 156 containing hydraulic fluid having an inlet port and an outlet port thereon. The control system 155 further includes a hydraulic pump 158 having an inlet port and an outlet port thereon. The outlet port of the storage tank 156 is connected to the inlet port of the hydraulic pump 158 by a feed line 159. The outlet port of the hydraulic pump 158 is connected to a fluid supply line 160. It should be appreciated that a pressure relief mechanism (not shown) can be disposed along the fluid supply line 160 as needed.

The control system 155 further includes the fluid supply line 160 connected to the hydraulic pump 158 and a valve 168 connected to the fluid supply line 160. The control system 155 also includes a fluid return line 164 connected to the reversing valve 168 and the storage tank 156. The control system 155 includes a fluid line 166 connected to the valve 168 and a feed or control valve 162 connected to the feedline 166. The control system 155 further includes a fluid line 170 connected to the feed valve 162 and a flow divider 172 connected to the fluid line 170. The control system 155 includes a feed line 174 connected to the flow divider 172 and a top feed wheel motor 176 connected to the feed line 174 and a return line 178 connected to the top feed wheel motor 176 and the feed valve 162. The control system 155 also includes a feed line 180 connected to the flow divider 172 and a bottom feed wheel motor 182 connected to the feed line 180 and a return line 184 connected to the bottom feed wheel motor 182 and the feed valve 162. The control system 155 includes a return line 186 connected to the valve 168 and the feed valve 162. It should be appreciated that pressurized fluid from the hydraulic pump 158 flows through the supply lines 160, 166, 170,74, 180 to the motors 176, 182, and return to the storage tank 156 through the return lines 164, 178, 184, 186. It also should be appreciated that the flow divider 172 divides the fluid flow between lines 174 and 180. It should further be appreciated that the feed valve 162 receives fluid from supply line 166 and returns fluid to return line 186. As such, control of the feed wheels (e.g., feed wheel hydraulic motors) can be effectuated in numerous manners and via the various components of the hydraulic system 155 and its operable connection with the one or more actuators 54.

In operation then, and restricting our discussion to the exemplary wood chipper: when the operator determines that the waste processing system is ready and desires the feed wheels to be engaged, the operator simply moves, presses, bumps, and holds the actuator 54. The wood is fed by the feed wheels to the cutting assembly and as the cutting assembly rotates and contacts the wood, the wood is cut or chipped and is then expelled out of the discharge chute. This process is continued, and the feed wheels operate until the operator releases the actuator 54, or if so equipped, the safety and control system 60 determines that the particular elapsed time has expired without the required actions (e.g., the actuator 54 is cycled off and then on again) as described in detail via the references wholly incorporated herein.

In one embodiment, actuator 54 is configured to be actuated by an operator's torso and is configured to be operable between a first predetermined state and a second predetermined state. For example, the first predetermined state may be operably connected to waste processing system 10 so as to provide continuity or a closed switch when an operator moves or positions actuator 54 in anything other than its normal state; while the second predetermined state may be configured to provide an open switch when the actuator 54 is not moved or positioned. For example, this may be accomplished through a normally off momentary switch or valve. In this manner, when actuator 54 is moved by the operator (e.g., rearwardly) the safety and control system 60 provides a closed circuit and the primary systems of waste processing system 10 operate normally. However, when actuator 54 is released from this moved state, or otherwise in a normal or unmoved state, the safety and control system 60 is configured and operably connected to one or more of the primary systems of waste processing system 10 so as to prevent, stop, or reverse the operation of one or more of the cutting system 40, the feed system 30, and the power system 18. This operational control, interruption, or stoppage of one or more of the cutting system 40, the feed system 30, and the power system 18 may be accomplished by having safety and control system 60 in direct and operable communication with the cutting system 40, the feed system 30, and the power system 18, or through one or more other components, and for example only, one or more other safety devices.

For example only, when actuator 54 is depressed, corresponding to the actuator moving to the use position or first predetermined state, normal operation of waste processing system 10 ensues. However, when actuator 54 is not depressed, moved, or otherwise activated, corresponding to the actuator being in the ready position or a second predetermined state, operation of the top feed control bar 52 is selectively restricted. As such, normal operation of top feed control bar 52 is permitted when the actuator 54 is in the ready position or first predetermined state, and restriction in the operation of top feed control bar 52 occurs when the actuator 54 is in the use position or second predetermined state. In further example, when in the second predetermined state, the top feed control bar 52 could be interrupted and restricted from activating feed system 30 or further, reversing the feed system. Alternatively, when actuator 54 is in the second predetermined state, the feed system 30 may be directly shut-off by actuator 54, or directly made to operate in a reverse mode.

Other alternate embodiments, configurations, and operable connections may comprise a safety and control system 60 which is adapted: to permit operation of both the cutting system 40 and the feed system 30 when the actuator is in the first predetermined state; to permit operation of at least one of the cutting system 40 and the feed system 30 when the actuator is in the first predetermined state; to interrupt operation of at least one of the feed system 30 and the cutting system 40 when the actuator is in the second predetermined state; to interrupt operation of the cutting system 40 and to permit motive operation of the feed system 30 in a reverse direction when the actuator is in the second predetermined state; to restrict operation of at least one of the cutting system 40 and the feed system 30 when the actuator is in the first or second predetermined state; to selectively control operation of at least one of the cutting system 40 and the feed system 30 when the actuator is in the first or second predetermined state; or to selectively brake at least one of the cutting system 40 and the feed system 30 when the actuator is in the second predetermined state, as required and for example by controlling and/or controlling access to other controllers, safety devices and the like.

Safety and control system 60 may be operably connected or in communication with one or more primary systems, subsystems, or components of waste processing system 10 and more particularly, with the feed system 30, the cutting system 40, and the power system 18 in any known manner and for example only, electrically, mechanically, or hydraulically. For example, actuator 54 may be adapted to operate a diverter valve which is configured to redirect a flow of hydraulic fluid from one or more of the primary systems of the waste processing system 10, more particularly feed system 30, toward a hydraulic reservoir when the actuator is in the second predetermined state.

By utilizing a torso actuated safety device, either alone or in conjunction with other controls (e.g., top feed control bar 52), increased control and safety in operation of these waste processing machines is accomplished. For example, the feed system, located at the narrowest point of the infeed chute, is a dangerous area and when operated improperly can cause injury to an operator (or the machine itself). Further exacerbating the situation is that if something were to become entangled in the feed system, the operator may not be able to reach or activate a shutoff. As such, the shutoff or other safety switch which is designed to activate when this emergency situation arises, may not activate due to various circumstances. However, with a torso actuated device, unless the proper force is applied to the bar, the system will automatically respond (stop). For example, if an operator were to be drawn into the machine, upon the operators torso being moved from its position the actuator would return to its normally biased position and would automatically and quickly be stopped, regardless of the operators response, or lack thereof.

Also disclosed is a method (200) of operating a waste processing system comprising: (210) providing a waste processing system 10 comprising a cutting system 40, a feed system 30, and a power system 18; (220) providing a safety and control system 60 comprising an actuator 54 disposed on a side 101 of the waste processing system 10 and adapted to permit operation of the feed system 30 when the actuator 54 is in a first predetermined state 55B, and adapted to interrupt operation of the feed system 30 when the actuator is in a second predetermined state 55A; (230) moving the actuator 54 in the first predetermined state 55B; (240) maintaining the actuator in the first predetermined state 55B; (250) Feeding material to the cutting system 40 via the feed system 30 in response to the actuator 54 being in the first predetermined state 55B; (260) releasing the actuator 54 to the second predetermined state 55A; and (270) interrupting operation of the feed system 30 in response to the actuator 54 being in the second predetermined state 55A. Further embodiment comprise: (280) initiating a time cycle (T) once the actuator 54 is moved to the first predetermined state 55B; (290) interrupting operation of the feed system 30 in response to the time cycle (T) having elapsed; and (300) re-initiating the time cycle (T) once the actuator 54 is moved from the first predetermined state 55B, to the second predetermined state 55A, and back to the first predetermined state 55B, thereby allowing operation of the feed wheels for the time cycle (T).

Also disclosed is a method (200) of operating a waste processing system comprising: (210) providing a waste processing system comprising a cutting system, a feed system, and a power system; providing a safety system 60 comprising a torso activated actuator 54 adapted to permit operation of the cutting system, the feed system, and the power system when the torso activated actuator 54 is in a first predetermined state 55B, and adapted to interrupt operation of at least one of the cutting system, the feed system, and the power system when the torso activated actuator 54 is in a second predetermined state 55A; (220) determining if the torso activated actuator 54 is in the first predetermined state 55B or the second predetermined state 55A; (230) operating the cutting system, the feed system, and the power system in response to the actuator 54 being in the first predetermined state 55B and requiring that the actuator 54 be continuously maintained in the first predetermined state 55B for operation thereof; and (240) interrupting operation of at least one of the cutting system, the feed system, and the power system in response to the actuator 54 being in the second predetermined state 55A.

To wit, an invention device, system and method has been disclosed wherein the system may be configured to increase the safety associated with the operation of, as well as the control of the waste processing system. In one particular embodiment, a novel device and system are disclosed which is conveniently located on the side of the infeed chute and allows for the operation and/or control of the waste processing system without using the operators hands.

While a linear sequence of events has been described, it should be appreciated that various modifications can be made therein and, as such, the system does not necessarily require a linear sequence of events. It is also to be understood that various modifications may be made to the system, it sequences, methods, orientations, and the like without departing from the inventive concept and that the description contained herein is merely a preferred embodiment and hence, not meant to be limiting unless stated otherwise.

Advantageously, the safety and control device, a safety and control system, and methods thereof of the present invention includes, among other advantages, the ability to increase safety and control, while priding a system and method that are simple, useful, and cost effective.

The solutions offered by the invention disclosed herein have thus been attained in an economical and practical manner. To wit, a novel safety and control device, a safety and control system, and methods thereof which is cost effective, easily configurable, and provides for increased operator safety and control has been invented. While preferred embodiments and example configurations of the inventions have been herein illustrated, shown, and described, it is to be appreciated that various changes, rearrangements, and modifications may be made therein, without departing from the scope of the invention as defined by the claims. It is intended that the specific embodiments and configurations disclosed herein are illustrative of the preferred and best modes for practicing the invention, and should not be interpreted as limitations on the scope of the invention as defined by the claims, and it is to appreciated that various changes, rearrangements, and modifications may be made therein, without departing from the scope of the invention as defined by the claims.

The invention claimed is:

1. A waste processing system comprising:

an infeed assembly for receiving waste material and comprising upstanding sides;

a cutting system for reducing the waste material;

a feed system for moving the waste material from the infeed assembly to the cutting system; and a safety system comprising:

a feed control bar mounted to the infeed assembly for controlling the feed system with the feed control bar movable between a first position to operate the feed system and a neutral position to prevent operation of the feed system;

an actuator mounted to the infeed assembly and operably connected to the feed system with the actuator positioned adjacent one of the upstanding sides of the infeed assembly and movable between a ready position to prevent operation of the feed system and a use position to permit operation of the feed system; and a biasing member coupled to the actuator and adapted to bias the actuator to the ready position to prevent operation of the feed system.

2. The waste processing system as set forth in claim 1, wherein the infeed assembly comprises an infeed chute and an infeed tray with the actuator pivotally mounted to the one of the upstanding sides of the infeed chute.

3. The waste processing system as set forth in claim 1, wherein the actuator is movable to a stored position opposite the ready position relative to the use position during non-operation of the feed system.

4. The waste processing system as set forth in claim 1, wherein the safety system further comprises:

a shaft operatively connected to the actuator; and a link having a first end operatively connected to the shaft and a second end operatively connected to the feed system such that the actuator is in mechanical communication with the feed system.

5. The waste processing system as set forth in claim 1, wherein the actuator is operably connected electronically with the cutting system such that operation of both the feed system and the cutting system is prevented when the actuator is in the ready position and operation of both the feed system and the cutting system is permitted when the actuator is in the use position.

6. The waste processing system as set forth in claim 1, wherein the actuator is operably connected hydraulically with the feed system.

7. The waste processing system as set forth in claim 6, wherein the hydraulic feed system further comprises a diverter valve in fluid communication with a hydraulic reservoir with the actuator operably connected to the diverter valve such that a flow of hydraulic fluid is redirected from the feed system to the hydraulic reservoir when the actuator moves from the use position to the ready position.

8. The waste processing system as set forth in claim 1, wherein the actuator permits operation of the feed control bar when the actuator is in the use position and prevents movement of the feed control bar when the actuator is in the ready position.

9. The waste processing system as set forth in claim 1, wherein the biasing member biasing the actuator to the ready position is configured to require the actuator be manually maintained in the use position in order to permit operation of the feed system.

10. The waste processing system as set forth in claim 1, wherein the actuator pivots parallel to the upstanding sides of the infeed assembly.

11. The waste processing system as set forth in claim 1, wherein the actuator is configured to pivot outwardly from the one of the upstanding sides of the infeed assembly from the ready position to the use position.

12. The waste processing system as set forth in claim 1, further comprising a power system in communication with one of the feed system and the cutting system with the actuator operably connected to the power system such that operation the power system is permitted when the actuator is in the use position and operation of the power system is interrupted when the actuator is in the ready position.

13. The waste processing system as set forth in claim 1, wherein the actuator further comprises a pair of actuators with one of the actuators of the pair of actuators operably connected to the feed system with the pair of actuators positioned adjacent to each of the upstanding sides of the infeed assembly and each actuator independently movable between the use position to permit operation of the feed system and the ready position to prevent operation of the feed system.

14. The waste processing system of claim 13, wherein each of the pair of actuators is biased to the ready position.

15. The waste processing system of claim 13, wherein the infeed assembly further comprises an infeed tray and an infeed chute having the upstanding sides with one of the actuators of the pair of actuators pivotally mounted to each of the upstanding sides of the infeed chute.

16. The waste processing system of claim 13, wherein each of the actuators is movable to a stored position opposite the ready position relative to the use position during non-operation of the feed system.

* * * * *